US010658790B2

(12) United States Patent
Finona

(10) Patent No.: US 10,658,790 B2
(45) Date of Patent: May 19, 2020

(54) SPLICE CONNECTOR ASSEMBLIES WITH SEALING GLAND

(71) Applicant: ITT Manufacturing Enterprises LLC, Wilmington, DE (US)

(72) Inventor: Michael Santos Finona, Fountain Valley, CA (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 0 days.

(21) Appl. No.: 15/993,386

(22) Filed: May 30, 2018

(65) Prior Publication Data

US 2018/0351292 A1 Dec. 6, 2018

Related U.S. Application Data

(60) Provisional application No. 62/512,946, filed on May 31, 2017, provisional application No. 62/539,867, filed on Aug. 1, 2017.

(51) Int. Cl.
*H01R 13/622* (2006.01)
*H01R 13/641* (2006.01)
(Continued)

(52) U.S. Cl.
CPC ..... *H01R 13/622* (2013.01); *H01R 13/5202* (2013.01); *H01R 13/5205* (2013.01);
(Continued)

(58) Field of Classification Search
CPC ..... H01R 13/622; H01R 13/5202; H01R 13/5205; H01R 13/59; H01R 13/641;
(Continued)

(56) References Cited

U.S. PATENT DOCUMENTS 2,015,953 A 10/1935 McDowell
2,605,315 A * 7/1952 Hargett ..... H01R 13/621 439/275
(Continued)

FOREIGN PATENT DOCUMENTS

EP 2 423 028 2/2012
EP 2 940 361 11/2015
(Continued)

OTHER PUBLICATIONS

"Aerospace Series Coupling Sleeve, for Contacts", Airbus S.A.S., ABS1617, Issue 2, Dec. 2016, pp. 7.
(Continued)

*Primary Examiner* — Travis S Chambers
(74) *Attorney, Agent, or Firm* — Knobbe Martens Olson & Bear LLP

(57) ABSTRACT

Various splice connector assemblies are disclosed. The splice connector assembly can include a connection unit mating a female and male terminals. The splice connector assembly can include an outer housing with an inner passage configured to receive the terminals. A first securing mechanism can be engaged with a first end of the outer housing and a second securing mechanism can be engaged with a second end of outer housing. The first and second securing mechanisms can each include a coupling nut engaged with the housing, a washer that is non-rotatably connected to the housing, and a sealing gland that comprises an aperture having a non-concentric cross sectional shape.

19 Claims, 34 Drawing Sheets

(51) Int. Cl.

| | |
|---|---|
| ***H01R 24/20*** | (2011.01) |
| ***H01R 24/28*** | (2011.01) |
| ***H01R 13/52*** | (2006.01) |
| ***H01R 13/59*** | (2006.01) |
| ***H01R 43/00*** | (2006.01) |
| *H01R 101/00* | (2006.01) |

(52) U.S. Cl.
CPC ..... *H01R 13/59* (2013.01); *H01R 13/641* (2013.01); *H01R 24/20* (2013.01); *H01R 24/28* (2013.01); *H01R 43/005* (2013.01); *H01R 2101/00* (2013.01)

(58) Field of Classification Search
CPC ..... H01R 24/20; H01R 24/28; H01R 43/005; H01R 2101/00; H01R 13/516; H01R 13/5213; H01R 13/5221; H01R 13/52; H02G 15/04; H02G 15/18
USPC ..... 439/271–277, 352, 355, 521, 321, 320, 439/367, 587, 589; 174/93
See application file for complete search history.

(56) References Cited

U.S. PATENT DOCUMENTS

| | | | | |
|---|---|---|---|---|
| 2,722,667 | A | 11/1955 | Huston | |
| 3,266,009 | A | 8/1966 | Jensen et al. | |
| 3,281,757 | A | 10/1966 | Bonhomme | |
| 4,072,381 | A | 2/1978 | Burkhart et al. | |
| 4,114,970 | A * | 9/1978 | Hall, Jr. ..... | H01R 13/523 439/294 |
| 4,538,053 | A | 8/1985 | Morrow et al. | |
| 4,571,018 | A * | 2/1986 | Annoot ..... | H01R 13/5205 439/275 |
| 4,676,574 | A * | 6/1987 | Grosso ..... | H01R 13/527 439/271 |
| 5,135,409 | A * | 8/1992 | Thompson ..... | H01R 13/6392 439/367 |
| 5,704,809 | A | 1/1998 | Davis | |
| 5,984,687 | A | 11/1999 | Schwarz | |
| 6,171,132 | B1 * | 1/2001 | Schmidt ..... | F16L 57/00 439/367 |
| 6,447,323 | B1 | 9/2002 | Watanabe | |
| 6,986,680 | B2 * | 1/2006 | Wu ..... | F21S 8/065 439/320 |
| 7,547,222 | B2 | 6/2009 | Otten | |
| 8,016,603 | B1 | 9/2011 | Tsai et al. | |
| 8,221,150 | B2 | 7/2012 | Houir Alami | |
| 8,579,658 | B2 | 11/2013 | Youtsey | |
| 8,591,247 | B2 * | 11/2013 | Zhu ..... | H01R 13/6273 439/352 |
| 9,325,124 | B2 * | 4/2016 | Zhao ..... | H01R 24/38 |
| 9,425,604 | B1 * | 8/2016 | Lawrence ..... | H02G 15/007 |
| 9,537,231 | B2 | 1/2017 | Hall et al. | |
| 10,056,745 | B2 * | 8/2018 | Nooner ..... | H02G 3/0406 |
| 2008/0248669 | A1 | 10/2008 | Wing et al. | |
| 2017/0054250 | A1 | 2/2017 | Kim et al. | |

FOREIGN PATENT DOCUMENTS

| | | |
|---|---|---|
| EP | 2 999 057 | 3/2016 |
| FR | 2 921 522 | 3/2009 |
| WO | WO 96/013080 | 5/1996 |

OTHER PUBLICATIONS

Extended European Search Report in European Patent Application No. 18174508.4, dated Oct. 23, 2018 in 9 pages.

* cited by examiner

SPLICE CONNECTOR ASSEMBLIES WITH SEALING GLAND

CROSS-REFERENCE

This application claims the priority benefit of U.S. patent application Ser. No. 62/512,946, filed May 31, 2017, and U.S. patent application Ser. No. 62/539,867, filed Aug. 1, 2017, the entirety of each of which is hereby incorporated by reference. This application also incorporates by reference the entirety of U.S. patent application Ser. No. 29/621,098, filed Oct. 4, 2017.

BACKGROUND

Field

This disclosure relates to splice connectors, such as connectors for splicing two electrical cables.

Certain Related Art

Electrical connectors are devices that are used to join electrical circuits using a mechanical assembly. Signals and/or power can be provided across the connector from a source device to a receiving device.

SUMMARY OF CERTAIN FEATURES

Some electrical connectors are splice connector assemblies. A splice connector assembly can enable first and second cables to be electrically connected. Splice connector assemblies can be beneficial, for example, when two cable ends are to be joined together and/or when a new portion of a cable is to be installed in place of a portion of a cable that has been damaged or removed. The splice connector assembly can facilitate in-the-field repair of electrical systems, such as the repair of electrical equipment on an airplane without needing to remove the equipment from the airplane.

In some embodiments, a splice connector assembly comprises a male terminal (also called a pin), a female terminal (also called a socket), an outer housing, and a securing mechanism. The terminals can each receive an end of a cable to provide an electrical connection between the cables when the terminals are engaged. The outer housing can be configured to receive the terminals. The outer housing can include ends with exterior threading. Each end of the housing can mate with a securing mechanism to secure the pin and/or socket in the housing. The securing mechanism can include a coupling nut, an anti-rotation washer, and a sealing gland. The coupling nut can thread onto the housing. The anti-rotation washer can have flanges that fit in corresponding grooves of the housing. The sealing gland can have an aperture that is non-concentric (e.g., elliptical) in cross-sectional shape to receive a similarly shaped cable.

The foregoing summary is a high-level overview of certain features of the disclosed technology. The summary is illustrative only and is not intended to be limiting. Other aspects, features, and advantages of the systems, devices, and methods and/or other subject matter described in this application will become apparent in the teachings set forth below. No feature in this disclosure is essential or critical.

BRIEF DESCRIPTION OF THE DRAWINGS

Various features and advantages of the splice connector assemblies described herein will become apparent from the following description, taken in conjunction with the accompanying drawings. These drawings depict several embodiments in accordance with the disclosure. The drawings are not to be considered limiting. In the drawings, similar reference numbers or symbols typically identify similar components, unless context dictates otherwise.

DETAILED DESCRIPTION OF CERTAIN EMBODIMENTS

Various features and advantages of the splice connector assemblies described herein will become more fully apparent from the following description of the several specific embodiments illustrated in the figures. These embodiments are intended to illustrate the principles of this disclosure. However, this disclosure should not be limited to only the illustrated embodiments. The features of the illustrated embodiments can be modified, combined, removed, and/or substituted as will be apparent to those of ordinary skill in the art upon consideration of the principles disclosed herein.

Figure 1:
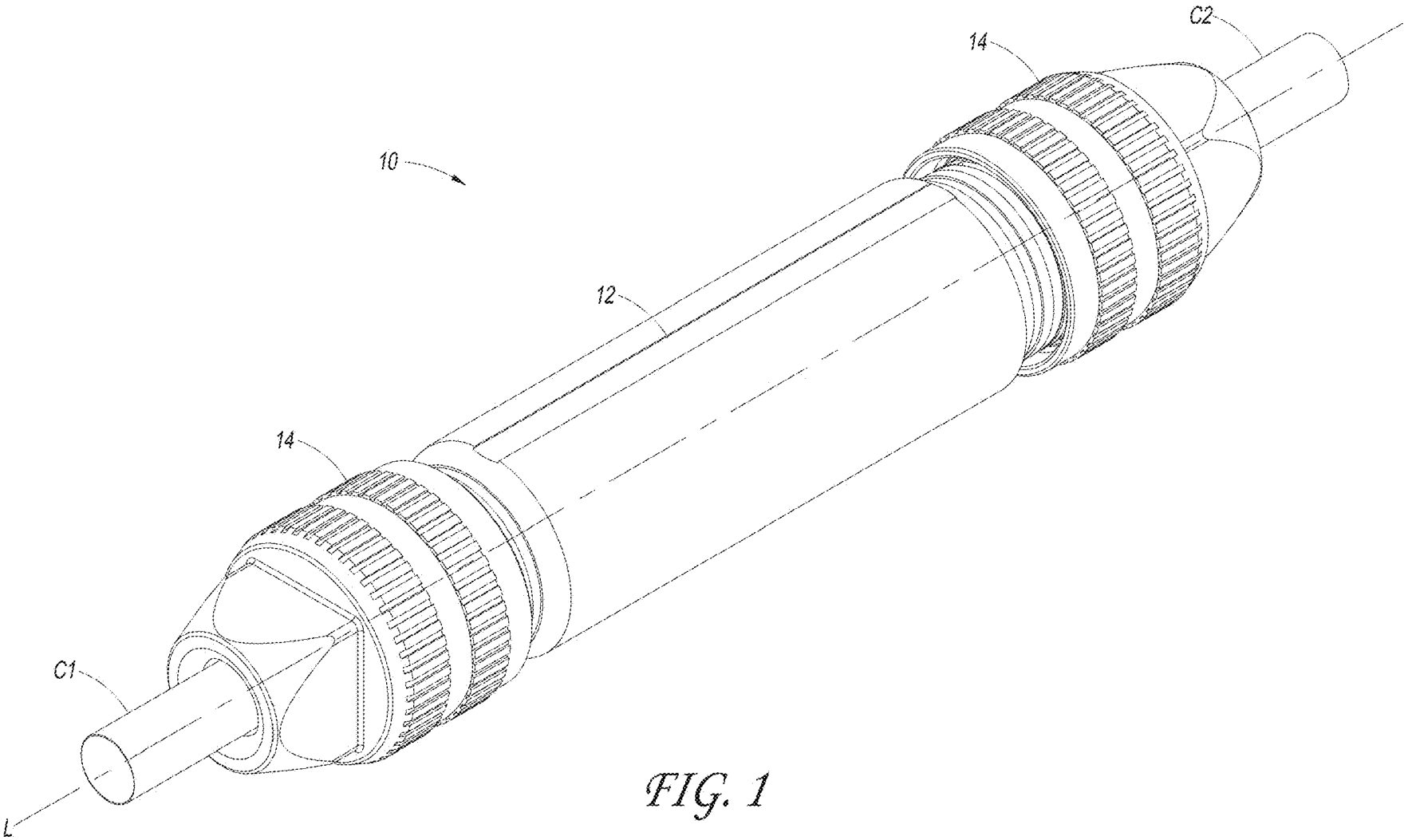
FIG. 1 illustrates a perspective view of a splice connector assembly.
Figure 2:
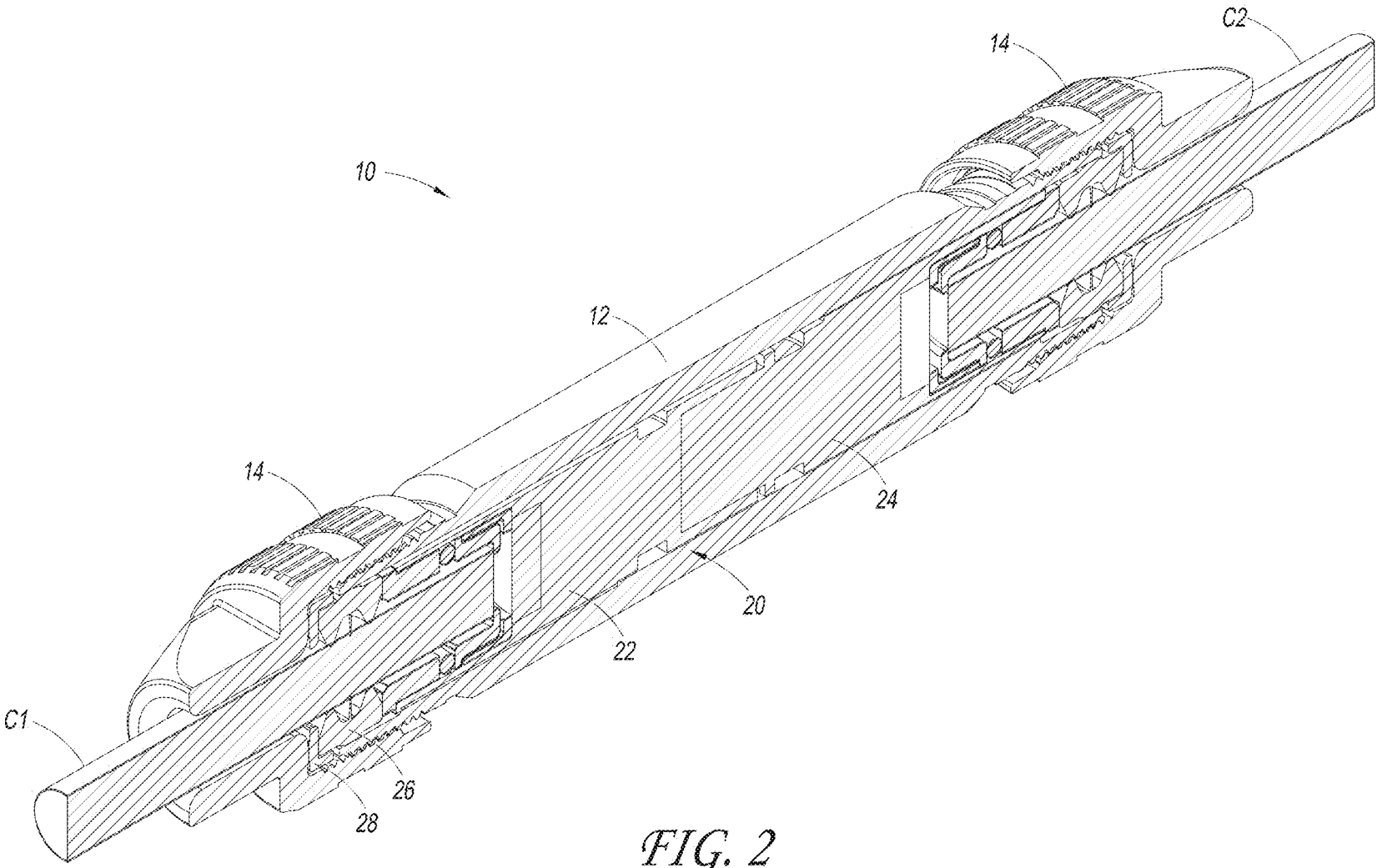
FIG. 2 illustrates a perspective cross-sectional view of the splice connector assembly of FIG. 1.
Figure 3:
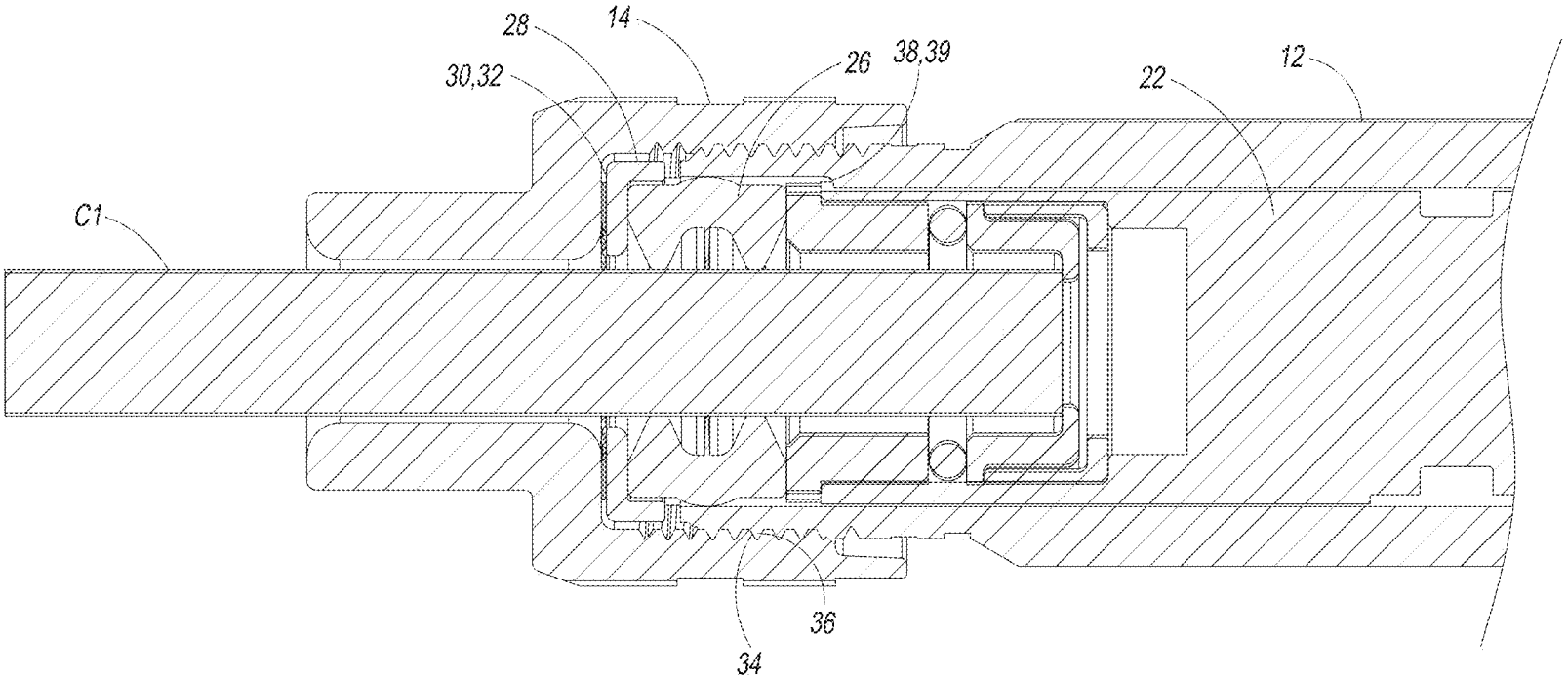
FIG. 3 illustrates a side cross-sectional view of a portion of the splice connector assembly of FIG. 1.

Overview (FIGS. 1-3)

FIGS. 1-3 illustrate an embodiment of a splice connector assembly 10. As shown, the splice connector assembly 10 can comprise an elongate unit with a longitudinal axis L. The splice connector assembly 10 can include a housing 12 and one or more coupling nuts 14. For example, the splice connector assembly 10 can have a first coupling nut 14 on a first end of the housing 12 and a second coupling nut 14 on a second end of the housing 12. In various embodiments, the coupling nut 14 and housing 12 are secured together, such as with mating threads. In some variants, the coupling nut 14 connects to the housing 12 with an interference fit, bayonet mount mechanism, or otherwise.

As shown, the splice connector assembly 10 can receive a first cable C1 and a second cable C2. The cables C1, C2 can comprise electrical cables with multiple conductors (e.g., multiple independent wires). In some embodiments, the first and second cables C1, C2 comprise Ethernet cables. The splice connector assembly 10 can couple the first and second cables C1, C2 together to enable electrical power and/or signals to pass between the cables C1, C2. The splice connector assembly 10 can provide a secure and/or sealed connection interface between the cables C1, C2. In various embodiments, as discussed in more detail below, the splice connector assembly 10 can be configured to inhibit or prevent unintended disconnection of the cables C1, C2, such as could be caused by vibration in an aerospace or other environment.

As shown in FIG. 2, the splice connector assembly 10 can include a connection unit 20, which can be received in the housing 12. The connection unit 20 can include a female terminal (also called a socket 22) and a male terminal (also called a pin 24). The socket 22 can connect with the first cable C1 and the pin 24 can connect with the second cable C2. The socket and pin 22, 24 can be configured to couple together to provide connectivity between the cables C1, C2. For example, the socket 22 can receive a portion of the pin 24 and mating electrical contacts of the socket 22 and pin 24 can engage to provide electrical communication.

As illustrated in FIG. 3, the housing 12 can include longitudinal ends with a diametrically enlarged portion. The housing 12 can include a shoulder 38 that engages with a mating shoulder 39 of the socket 22 and/or pin 24. This can provide a physical interference and/or can limit the amount that the socket 22 and/or pin 24 can be inserted into the housing 12.

As also shown in FIG. 3, the coupling nut 14 and housing 12 can comprise mating threads 34, 36. This can enable the coupling nut 14 to be threadably engaged with the housing 12. In some embodiments, when the coupling nut 14 is tightened against the housing 12, the coupling nut 14 presses on a washer 28, which in turn presses on a sealing gland 26 around the cable. For example, the sealing gland 26 can be compressed between the washer 28 and the connection unit 20. The compression can result in the sealing gland 26 being radially compressed around the cable, which can inhibit dirt or other contaminants from reaching the connection unit 20. In certain embodiments, a securing mechanism comprises the coupling nut 14, sealing gland 26, and washer 28.

In various embodiments, the splice connector assembly 10 can be configured to reduce the chance of unintentional loosening of the coupling nut 14. For example, as discussed in more detail below, the coupling nut 14 can include a first anti-rotation feature 30 and the washer 28 can include a corresponding second anti-rotation 32 feature. The anti-rotation features 30, 32 can engage to inhibit rotation of the coupling nut 14 relative to the washer 28, such as could otherwise be induced by vibration or other forces.

In some implementations, the splice connector assembly 10 provides a relatively short and/or compact device for splicing cables. This can be beneficial, for example, in the tight quarters of many aerospace electrical chases and wiring applications. For example, in some implementations, the overall longitudinal length of the splice connector assembly 10 is less than or equal to about 6 times the diameter of the housing 12. In some embodiments, the overall length of the splice connector assembly 10 is less than or equal to about 2 times (e.g., about 1.6 times) the length of the connection unit 20.

In various embodiments, splice connector assembly 10 is configured to be readily disassembled, removed, and/or reversed. This can be convenient for future maintenance of the cables C1, C2 and/or can enable reuse of the splice connector assembly 10. For example, the splice connector assembly 10 can be configured to be uninstalled from the first and second cables C1, C2, and installed onto third and fourth cables (not shown). Some embodiments of the splice connector assembly 10 are configured to be disassembled and such that a splice between the cables C1, C2 can be disconnected. For example, in some implementations, the coupling nuts 14 can be unthreaded from the housing 12, the pin 24 and socket 22 can be decoupled from each other and separated from the housing 12, and the components of the pin 24 and socket 22 can be removed from the cables C1, C2. In several embodiments, installation of the splice connector assembly 10 does not include a substantially permanent change to the cables C1, C2. For example, the splice connector assembly 10 can be installed without soldering components to wires of the cables C1, C2 and/or without piercing the insulation of the cables C1, C2. In some variants, crimping of contacts to ends of the wires is not a substantially permanent change to the cables C1, C2.

The splice connector assembly 10 can comprise various materials. In certain embodiments, components of the splice connector assembly 10 (e.g., the housing 12, coupling nut 14, and/or washer 28) are made of a metal, such as an aluminum alloy, or a thermoplastic. In some embodiments, components of the splice connector assembly 10 (e.g., the housing 12, coupling nut 14, and/or washer 28) are plated or coated, such as using an electroless nickel plating process. In some embodiments, certain portions of the splice connector assembly 10, such as the sealing gland 26, comprise an elastomeric material. For example, in some embodiments, the sealing gland 26 can be made of a rubber, such as fluorosilicone.

Figure 4:
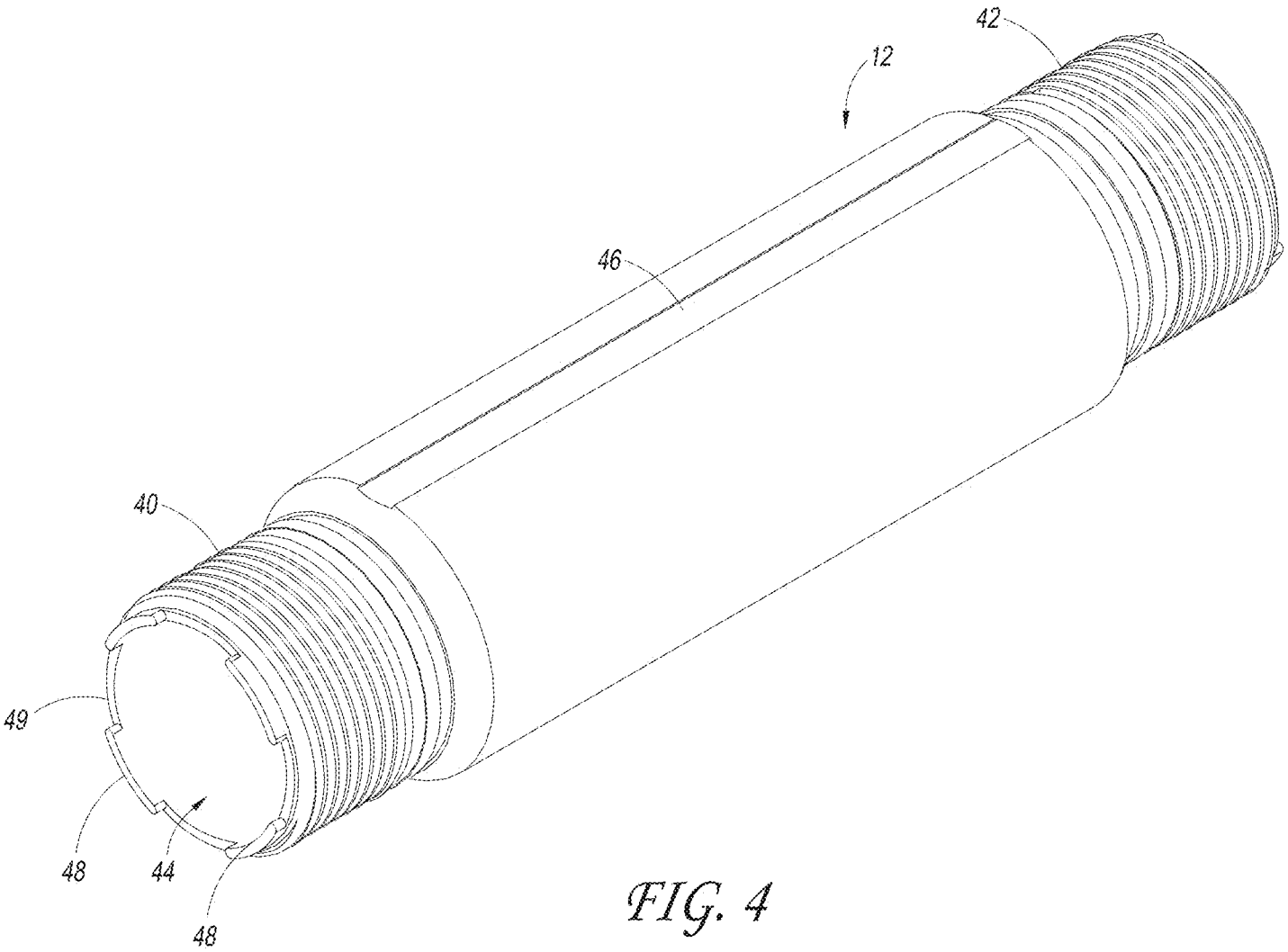
FIG. 4 illustrates a perspective view of a housing of the splice connector assembly of FIG. 1.
Figure 5:
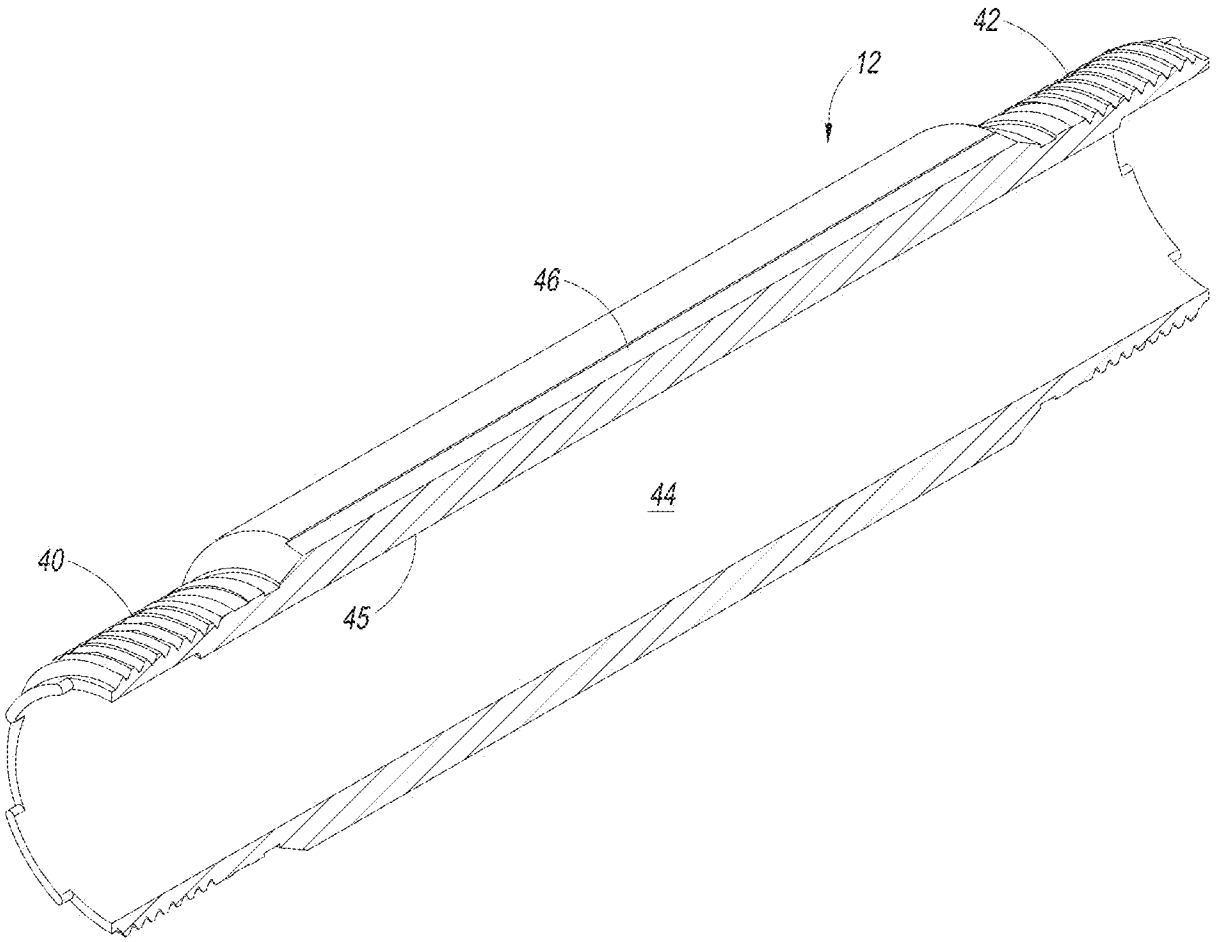
FIG. 5 illustrates a perspective cross-sectional view of the housing of FIG. 4.

Housing (FIGS. 4 and 5)

FIGS. 4 and 5 illustrate an example of the housing 12. As shown, the housing 12 can comprise a hollow tubular member, such a cylindrical pipe. The housing 12 can comprise an elongate member. The embodiment shown has a substantially circular cross-sectional shape, though other shapes are contemplated as well, such as a rectangular, square, elliptical, or otherwise. The housing 12 can have a first end 40 and a second end 42. The ends 40, 42 can comprise the threads 36 mentioned above. The ends 40, 42 can comprise features that are configured to mate with the washer 28. For example, as illustrated, the housing 12 can include flanges 48 and recesses 49. In some variants, the ends 40, 42 comprise teeth, ribs, grooves, or other features.

As shown in FIG. 5, the housing 12 can have an inner passage 44 that extends from the first end 40 to the second end 42. The inner passage 44 can be configured to receive the connection unit 20. An inside surface of the housing 12 can include an orientation feature 45, such as a radially inwardly or outwardly keyway, groove, rib, or otherwise. The orientation feature 45 can be configured to engage with a corresponding feature of the connection unit 20, as described in more detail below.

In some embodiments, the orientation feature 45 can be circumferentially aligned with an orientation indicator 46, which can be on the outside of the housing 12. In the embodiment shown, the orientation indicator 46 comprises a longitudinal groove. In some variants, the orientation indicator 46 comprises a painted indicator, raised indicator (e.g., a rib), arrow, text, or otherwise. As discussed below in more detail, the orientation indicator 46 can aid in properly aligning the socket 22 and pin 24 with each other and/or with the orientation feature 45 of the housing 12.

Figure 6:
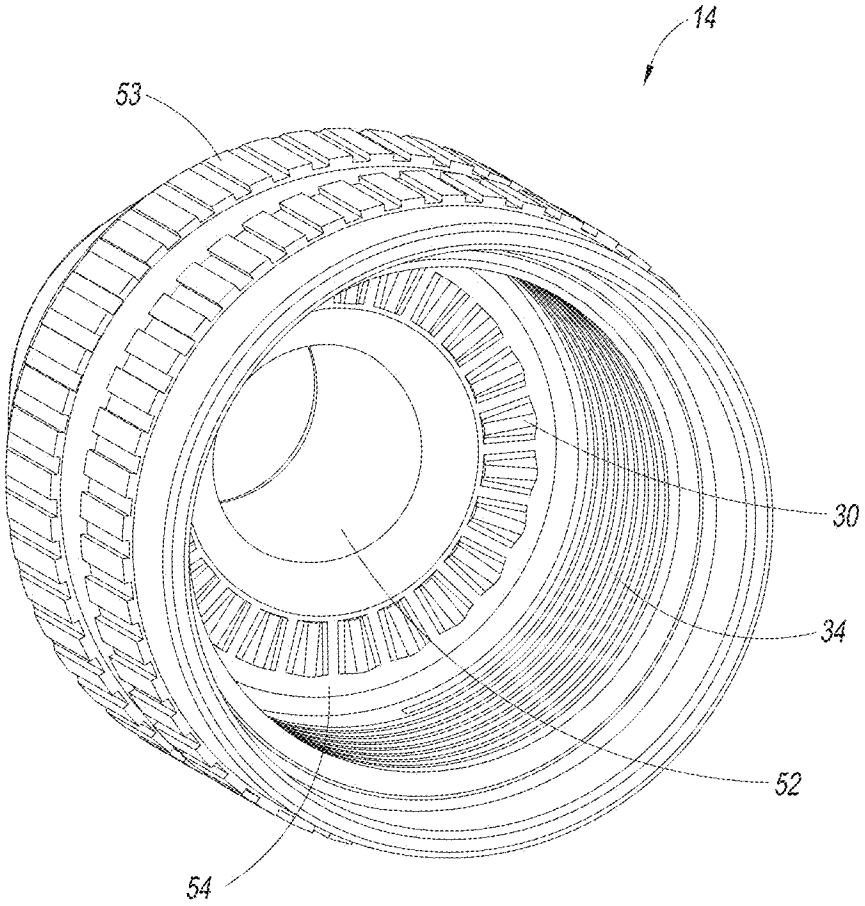
FIG. 6 illustrates a rear perspective view of a coupling nut of the splice connector assembly of FIG. 1.
Figure 7:
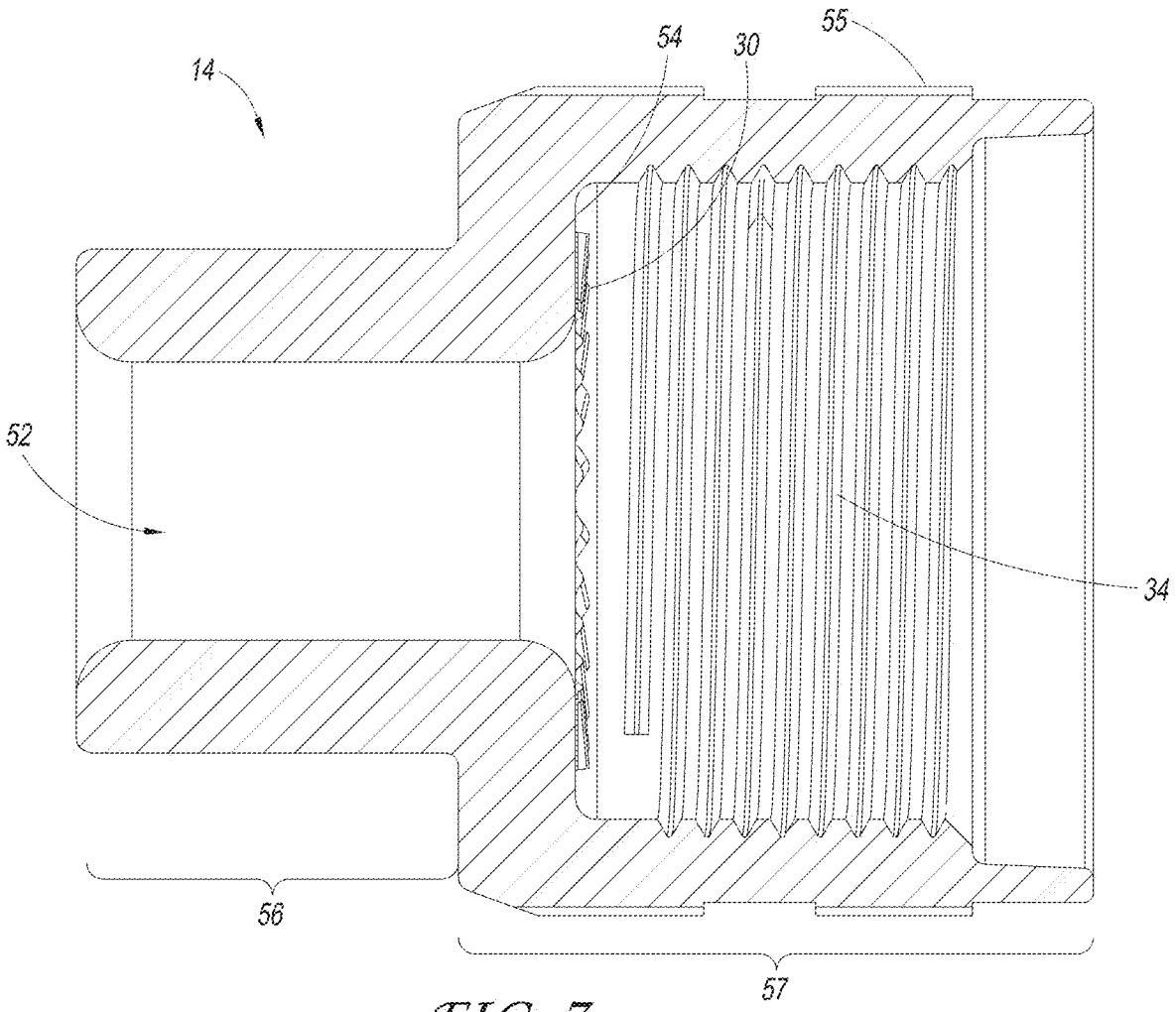
FIG. 7 illustrates a side cross-sectional view of the coupling nut of FIG. 6.

Coupling Nut (FIGS. 6 and 7)

FIGS. 6 and 7 illustrate an embodiment of the coupling nut 14. As previously mentioned, the coupling nut 14 can be configured to mate with the housing 12, such as with threads 34. The coupling nut 14 can include a longitudinally-extending aperture 52 that is configured to enable the receive one of the cables C1, C2.

In various embodiments, the coupling nut 14 comprises a gripping feature 55 on an exterior surface. For example, the coupling nut 14 can include knurling. The gripping feature 53 can aid a user in turning the coupling nut 14 when tightening or loosening (e.g., threading or unthreading) the coupling nut 14 relative to the housing 12. In some implementations, the coupling nut 14 includes faces (see FIG. 1) that are configured to receive a tool, such as a wrench, to facilitate applying torque to the coupling nut 14.

The coupling nut 14 can include the anti-rotation feature 30. In the embodiment illustrated, anti-rotation feature 30 comprises a plurality of ridges. The ridges can be rounded or angled in the circumferential direction. In some embodiments, the anti-rotation feature 30 comprises a plurality of teeth, dimples, grooves, recesses, or otherwise. As shown, the anti-rotation feature 30 can be positioned on a longitudinally facing shoulder 54 of the coupling nut 14.

In some implementations, the coupling nut 14 can include a first portion 56 and a second portion 57. In certain embodiments, the first portion 56 is non-threaded and the second portion 57 is threaded. The first portion 56 can provide strain relief to the cable received in the aperture 52. In certain embodiments, the longitudinal length of the first portion 56 is less than the longitudinal length of the second portion 57. As illustrated, the first portion 56 can have a diameter that is less than or equal to the diameter of the second portion 57. For example, the ratio of the diameter of the first portion 56 to the diameter of the second portion 57 can be less than or equal to about: 0.8, 0.7, 0.6, 0.5, ratios between the aforementioned ratios, or other ratios. In some implementations, the longitudinal length of the first portion 56 is about equal to the diameter of the first portion 56.

Figure 8:
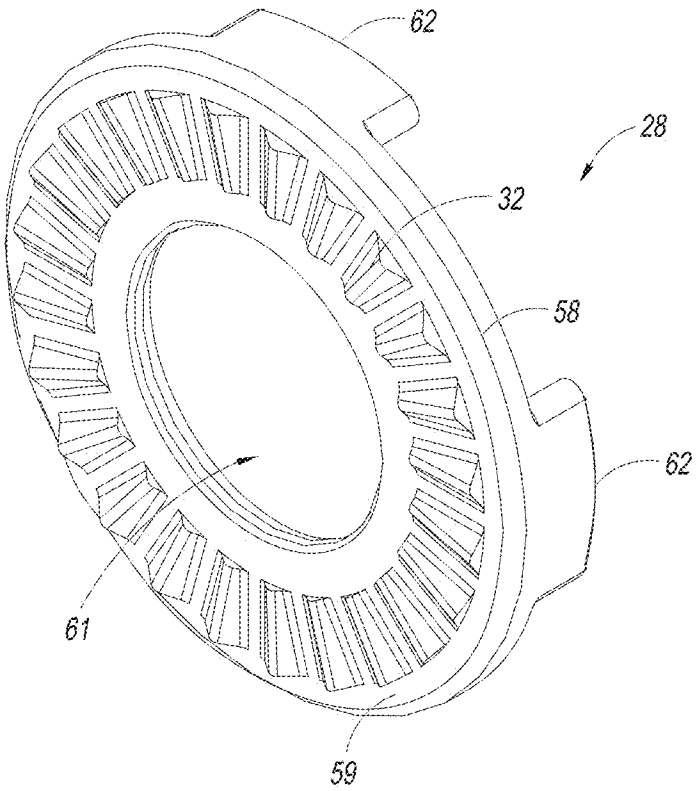
FIG. 8 illustrates a front perspective view of a washer of the splice connector assembly of FIG. 1.
Figure 9:
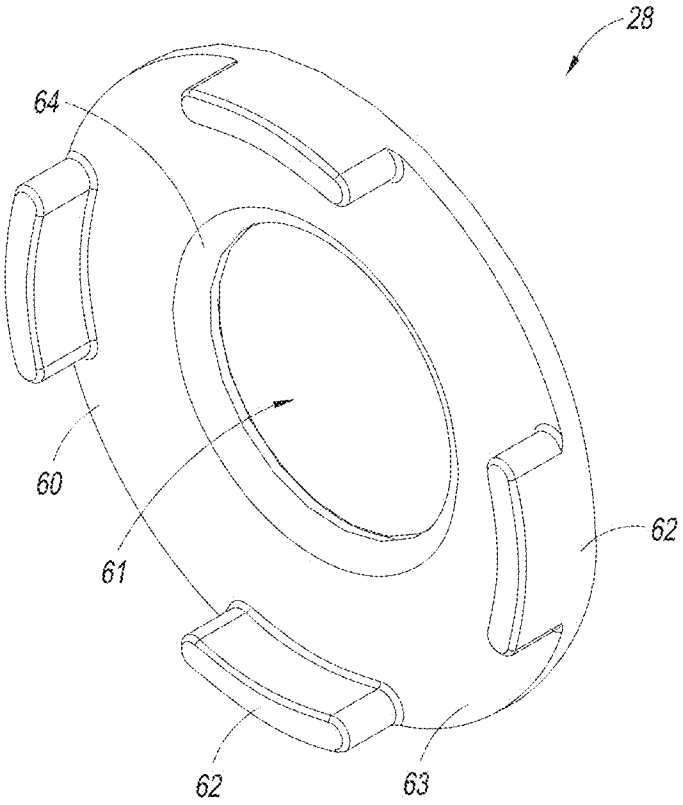
FIG. 9 illustrates a rear perspective view of the washer of FIG. 8.
Figure 10:
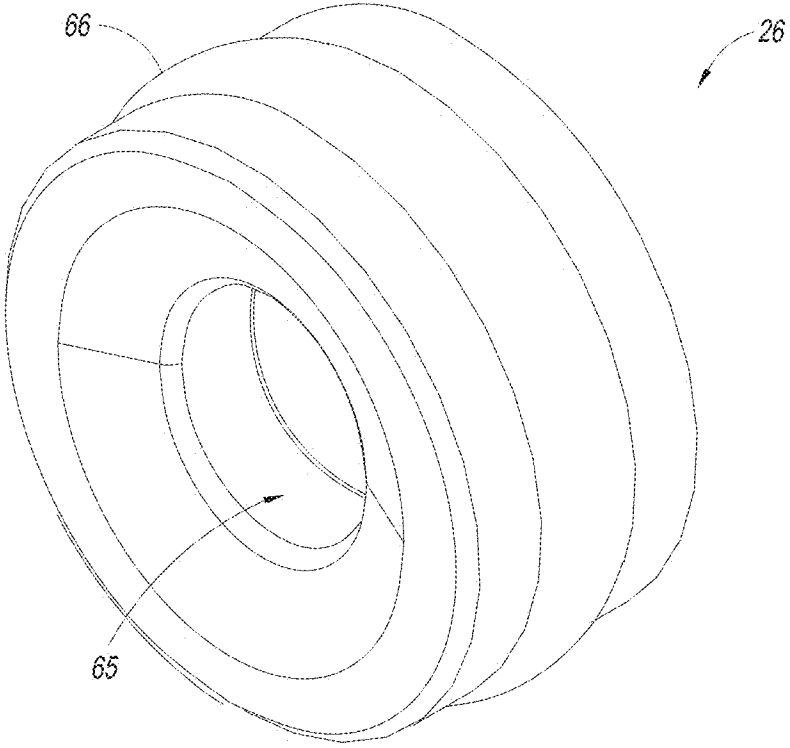
FIG. 10 illustrates a front perspective view of a sealing gland of the splice connector assembly of FIG. 1.

Washer (FIGS. 8 and 9)

FIGS. 8 and 9 illustrate an example of the washer 28. In some embodiments, the washer 28 comprises an annular body 58, a front face 59, and a rear face 60. The washer 28 can include an aperture 61 that can receive one of the cables C1, C2. As illustrated, the rear of the aperture 61 can be bounded by a curved or chamfered surface 64, such as a surface that is curved or chamfered radially outward. In some embodiments, the rear face 60 of the washer 28 is substantially smooth and/or generally planar.

In various embodiments, the washer 28 is configured to engage with the coupling nut 14. For example, the front face 59 of the washer 28 can be engaged with the shoulder 54 of the coupling nut 14 (see FIG. 3). As illustrated in FIG. 8, the front face 59 of the washer 28 can include the anti-rotation feature 32. In various embodiments, when the coupling nut 14 has been secured (e.g., threaded) against the housing 12, the anti-rotation feature 32 of the washer 28 is engaged with the anti-rotation feature 30 of the coupling nut 14. This can inhibit unintentional relative rotation of the washer 28 and the coupling nut 14, such as due to the vibrations that are typically experienced on an aircraft. As illustrated, the anti-rotation feature 32 can comprise a plurality of ridges. The ridges can be angled or curved in the circumferential direction. In some implementations, the anti-rotation feature 32 comprises teeth, dimples, grooves, recesses, or otherwise. In some embodiments, the anti-rotation feature 32 of the washer 28 is substantially identical to the anti-rotation feature 30 on the coupling nut 14. In certain variants, the rotation feature 32 is different than the anti-rotation feature 30. For example, the anti-rotation feature 32 can comprise plurality of projections and the anti-rotation feature 30 can comprise a plurality of recesses, or vice versa. In some implementations, the anti-rotation feature 30 is configured to slide (e.g., circumferentially) relative to the anti-rotation feature 32, such as when the coupling nut 14 is being turned relative to the washer 28 and/or housing 12.

The washer 28 can include features that matingly engage with corresponding features of the housing 12. For example, as shown, the washer 28 can include flanges 62 and/or recesses 63. In some embodiments, the flanges 62 of the washer 28 can be received in recesses 49 of the housing 12 and/or recesses 63 of the washer 28 can be received in flanges 48 of the housing 12. The engagement between the mating features of the washer 28 and housing 12 can provide a physical interference in the circumferential direction, thereby inhibiting or preventing relative rotation of the washer 28 and the housing 12. In some implementations, the washer 28 and the housing 12 are substantially circumferentially stationary, even as the coupling nut 14 is being rotated relative to the housing 12.

In various embodiments, the washer 28 is configured to move longitudinally relative to the housing 12 but substantially without rotation relative to the housing 12. The longitudinal movement can be a result of the coupling nut 14 threading with the housing 12 and engaging with the washer 28. The lack of circumferential movement can be because of the engagement between the mating features of the washer 28 and housing 12, as discussed above. Such movement of the washer 28 substantially only in the longitudinal direction can beneficially reduce or avoid twisting and/or imparting a torque from the coupling nut 14 onto the sealing gland 26. This can reduce the chance of damage to the sealing gland 26.

Sealing Gland (FIGS. 10-14)

FIGS. 10 through 14 illustrate an example of the sealing gland 26. As shown, the sealing gland 26 can comprise an annular shape. The sealing gland 26 can include a passage 65 that extends from a first side to a second side of the sealing gland 26. The passage 65 can be configured to receive one of the cables C1, C2. A radially outer surface of the washer 28 can include an abutting feature, such as a rib 66. The rib 66 can be configured to engage and/or abut with an inner surface of the housing 12 to provide sealing engagement with the housing 12. The rib 66 can have an outwardly bowed and/or curved profile. In some embodiments, the rib 66 has a longitudinal width of greater than or equal to about ⅓ of the longitudinal width of the sealing gland 26.

Figure 11:
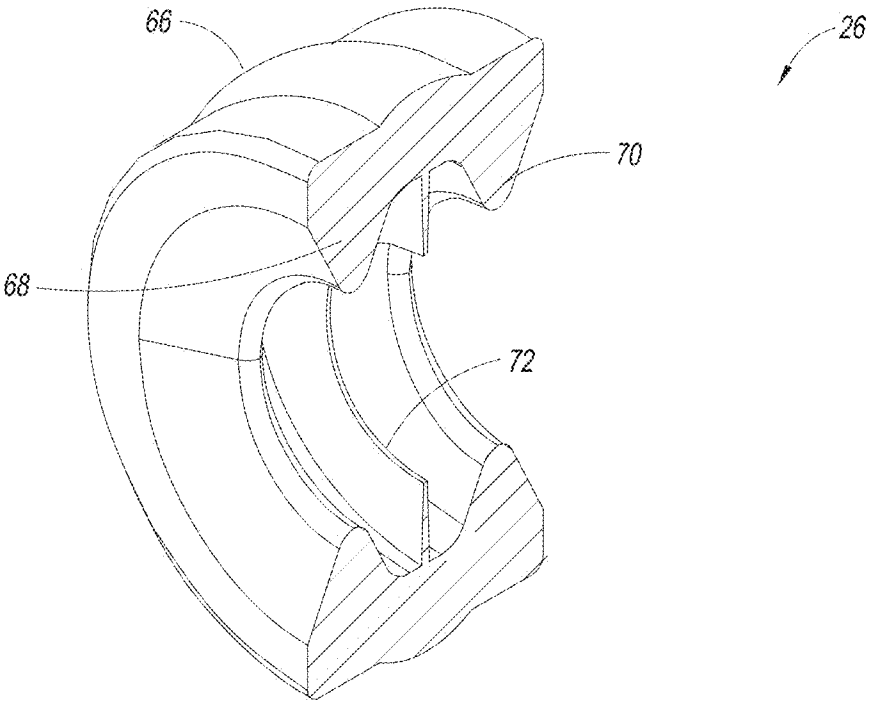
FIG. 11 illustrates a perspective cross-sectional view of the sealing gland of FIG. 10.
Figure 12:
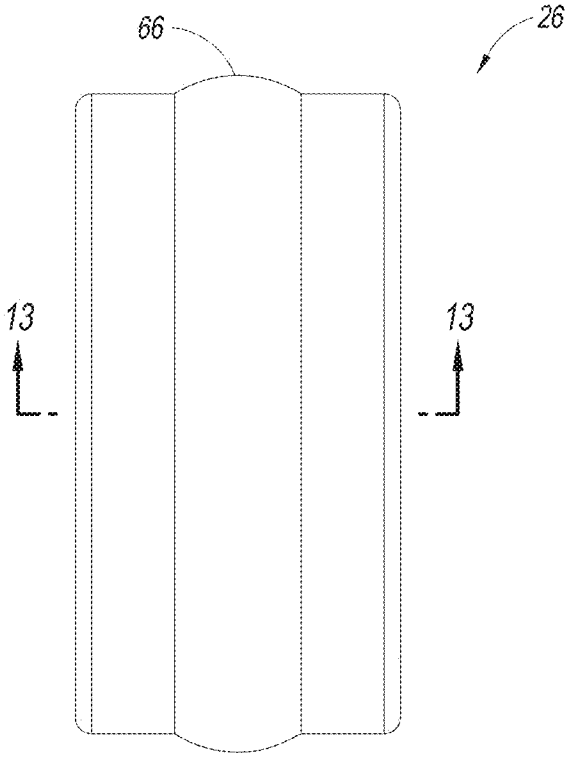
FIG. 12 illustrates a top view of the sealing gland of FIG. 10. The bottom view, right side view, and left side view are substantially the same.
Figure 13:
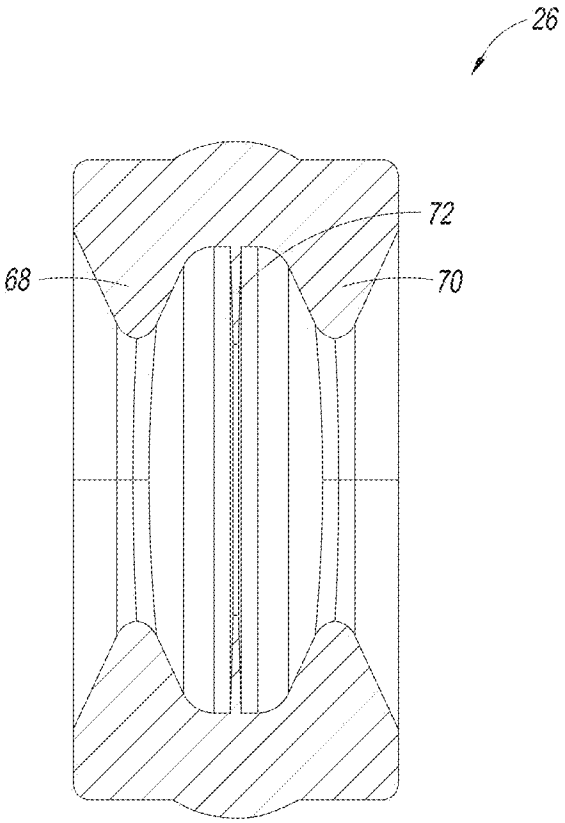
FIG. 13 illustrates a cross-sectional view along the line 13-13 of FIG. 12.

An inner surface of the washer 28 can include one or more sealing features. For example, as shown in FIG. 11, the inner surface can include a first sealing rib 68 and a second sealing rib 70, which can extend radially inwardly. The first and/or second sealing ribs 68, 70 can be configured to radially sealingly engage with the cable. As shown, in some embodiments, the first and second sealing ribs 68, 70 have a generally triangular cross-section.

In some embodiments, the washer 28 includes a divider, such as a wall 72, positioned between the first and second sealing ribs 68, 70. In some embodiments, the wall 72 is configured to radially seal against the cable. The wall 72 can have a longitudinal width that is less than the longitudinal width of the first and/or second sealing ribs 68, 70.

Figure 14:
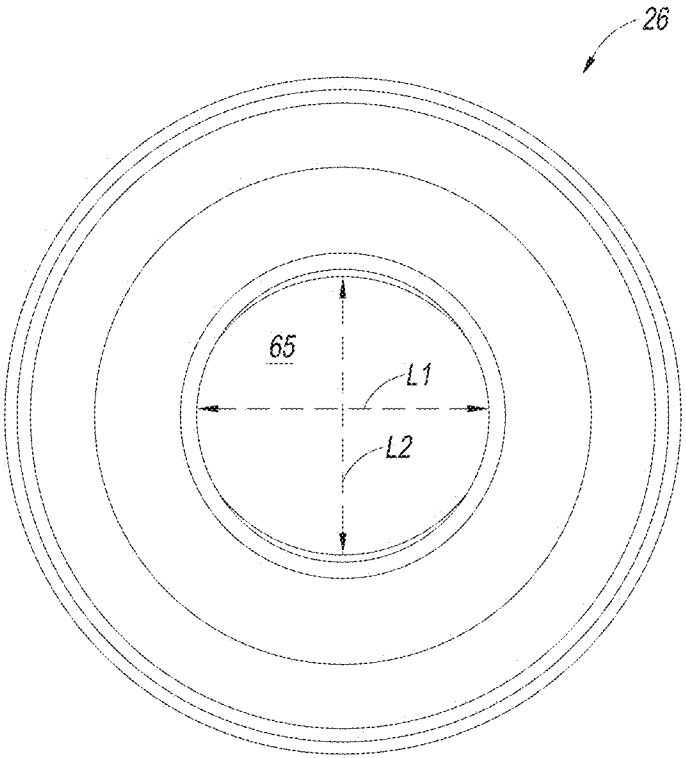
FIG. 14 illustrates a front view of the sealing gland of FIG. 10. The rear view is substantially the same.

In certain implementations, the sealing gland 26 is configured to accommodate and/or sealingly engage with non-concentric cables, such as certain Ethernet cables. For example, the passage 65 can have a non-concentric shape, such as is illustrated in FIG. 14. The passage 65 can have a length L1 along the X axis and a length L2 along the Y axis. In some embodiments, the length L1 is greater than the length L2. In various embodiments the ratio of the length L1 to the length L2 is at least about: 1.01, 1.05, 1.1, 1.2; values between the aforementioned values, or other values.

As previously mentioned, in some embodiments, the washer 28 is made of an elastomeric material, such as rubber. In some embodiments, the washer 28 is made of fluorosilicone. The sealing gland 26 can be prone to damage when subjected to a torque. As mentioned above, the splice connector assembly 10 can be configured to reduce or avoid such damage by applying substantially only a longitudinal force to the sealing gland 26. In various embodiments, substantially no torque is applied to the sealing gland 26 during rotation of the coupling nut 14. In certain variants, the sealing gland 26 is compressed by longitudinal movement of the washer 28 and/or substantially without rotational movement of the washer 28 relative to the sealing gland 26. In some embodiments, the washer 28 and sealing gland 26 do not rotate relative to each other.

Referring back to the assembled view of FIG. 3, in some embodiments, in the assembled splice connector assembly 10, a portion of the sealing gland 26 projects longitudinally out of the housing 12. For example, the first sealing rib 68 can be positioned outside of the housing 12. In certain embodiments, the coupling nut 14 and/or washer 28 are not positioned in the housing 12. As illustrated, the rib 66 can engage with an inner surface of the housing 12, such as at or near an end of the housing 12.

In certain embodiments, the sealing gland 26 can act as a biasing member. For example, the sealing gland 26 can bias the washer 28 toward the coupling nut 14. During tightening of the coupling unit 14 (e.g., threading onto the housing 12), the washer 28 can be longitudinally moved against the bias of the sealing gland 26. The mating features of the housing 12 and the washer 28 can be configured to permit such longitudinal movement of the washer 28. For example, the flanges 48, 62 and/or recesses 49, 63 of the housing 12 and washer 28 can have generally parallel sides and/or sides that are generally parallel to the longitudinal axis.

Figure 15:
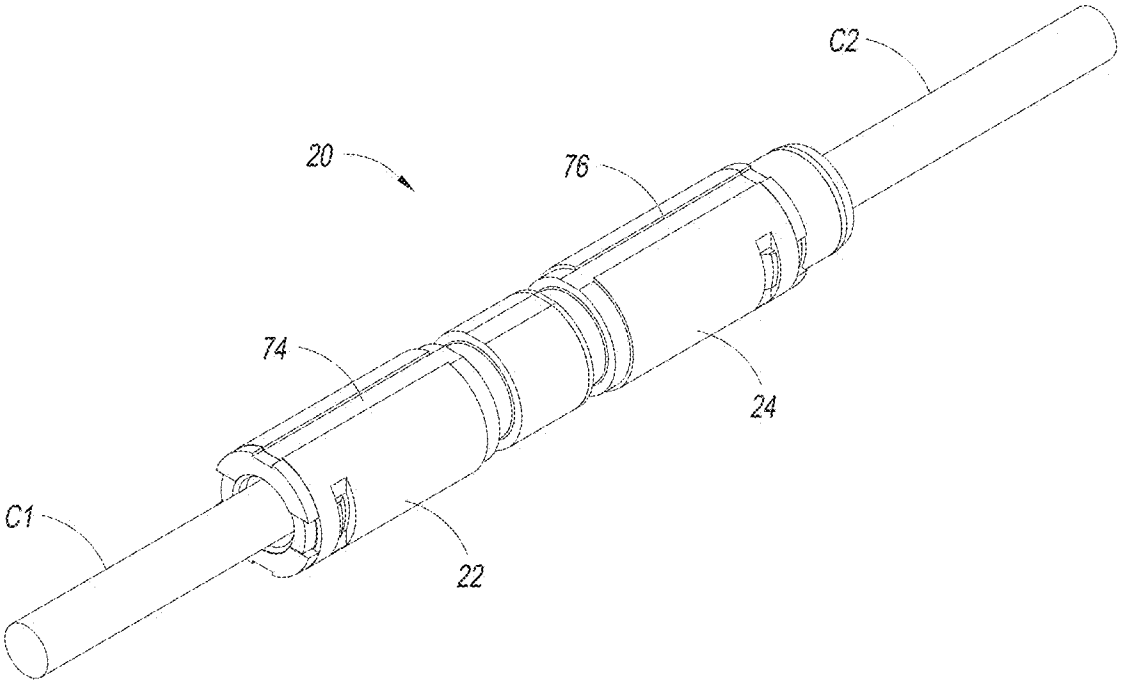
FIG. 15 illustrates a perspective view of a connection unit of the splice connector assembly of FIG. 1.

Connection Unit (FIG. 15)

FIG. 15 illustrates an example of the connection unit 20. As previously mentioned, the connection unit 20 can include the socket 22 and the pin 24. The socket 22 and pin 24 can couple together to provide connectivity between the first and second cables C1, C2. In various implementations, during assembly of the splice connector assembly 10, the socket 22 is installed into the housing 12 from the first end 40 of the housing 12 and the pin 24 is installed into the housing 12 from the second end 42 of the housing 12.

As shown, the socket 22 can include an orientation feature 74 and the pin 24 can include an orientation feature 76. The orientation features 74, 76 can comprise a radially inwardly or outwardly keyway, groove, rib, or otherwise. In the embodiment illustrated, the orientation features 74, 76 comprise longitudinal grooves. The orientation features 74, 76 of the socket 22 and pin 24 can be configured to mate with the orientation feature 45 of the housing 12. For example, the grooves 74, 76 can receive the rib 45. This can provide a predetermined orientation of the connection unit 20 relative to the housing 12 when the connection unit 20 is installed inside the housing 12.

The mating orientation features 74, 45 on the socket 22 and housing 12, and the orientation features 76, 45 on the pin 24 and housing 12, can facilitate properly orienting the socket 22 and pin 24 inside the housing 12, so that the socket 22 and pin 24 can properly couple together inside the housing 12. In some embodiments, the orientation features 45, 74, 76 of the housing 12, socket 22, and pin 24 enable the socket 22 and pin 24 to be bind-mated within the housing 12. For example, the socket 22 and pin 24 can be coupled inside the housing 12 without a user seeing the mating ends of the socket 22 and pin 24 engaging together.

In some embodiments, the orientation indicator 46 facilitates aligning the orientation features 74, 76 of the socket and/or pin 24 with the orientation feature 45 of the housing 12. For example, in some embodiments, aligning the orientation features 74, 76 with the orientation indicator 46 automatically aligns the orientation features 74, 76 with the orientation feature 45. As mentioned above, in some embodiments, the orientation indicator 46 is circumferentially aligned with the orientation feature 45. In some implementations, the orientation indicator 46 is readily visible to a user, such as being located on an external surface of the housing 12. In some implementations, the orientation indicator 46 comprises a projecting and/or recessed stripe. The orientation indicator 46 can be a different color than the surrounding portions of the housing 12, such as being painted a different color.

Socket (FIGS. 16-19)

Figure 16:
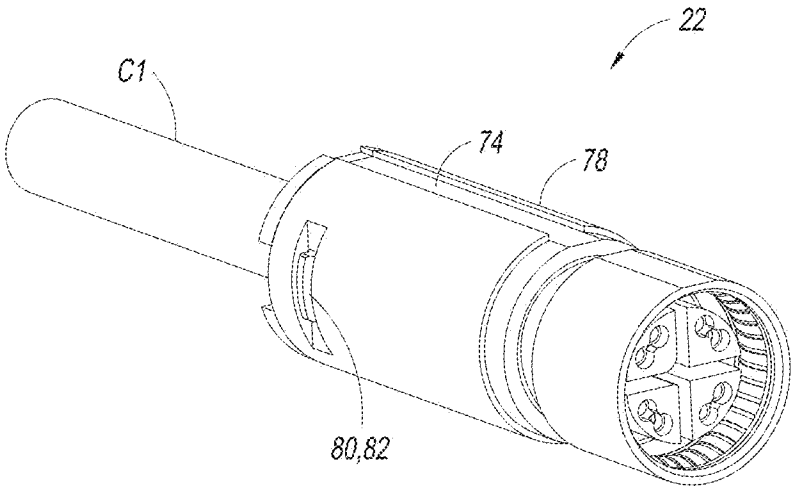
FIG. 16 illustrates a perspective view of a socket of the connection unit of FIG. 15.

FIG. 16 illustrates an example of the socket 22. In some embodiments, the socket 22 comprises an outer body 78, which can include the orientation feature 74 discussed above. As shown, the outer body 78 can include a locking mechanism 80, which can engage with a corresponding locking mechanism 82 to secure the socket 22 together as a unit, as will be discussed below.

Figure 17:
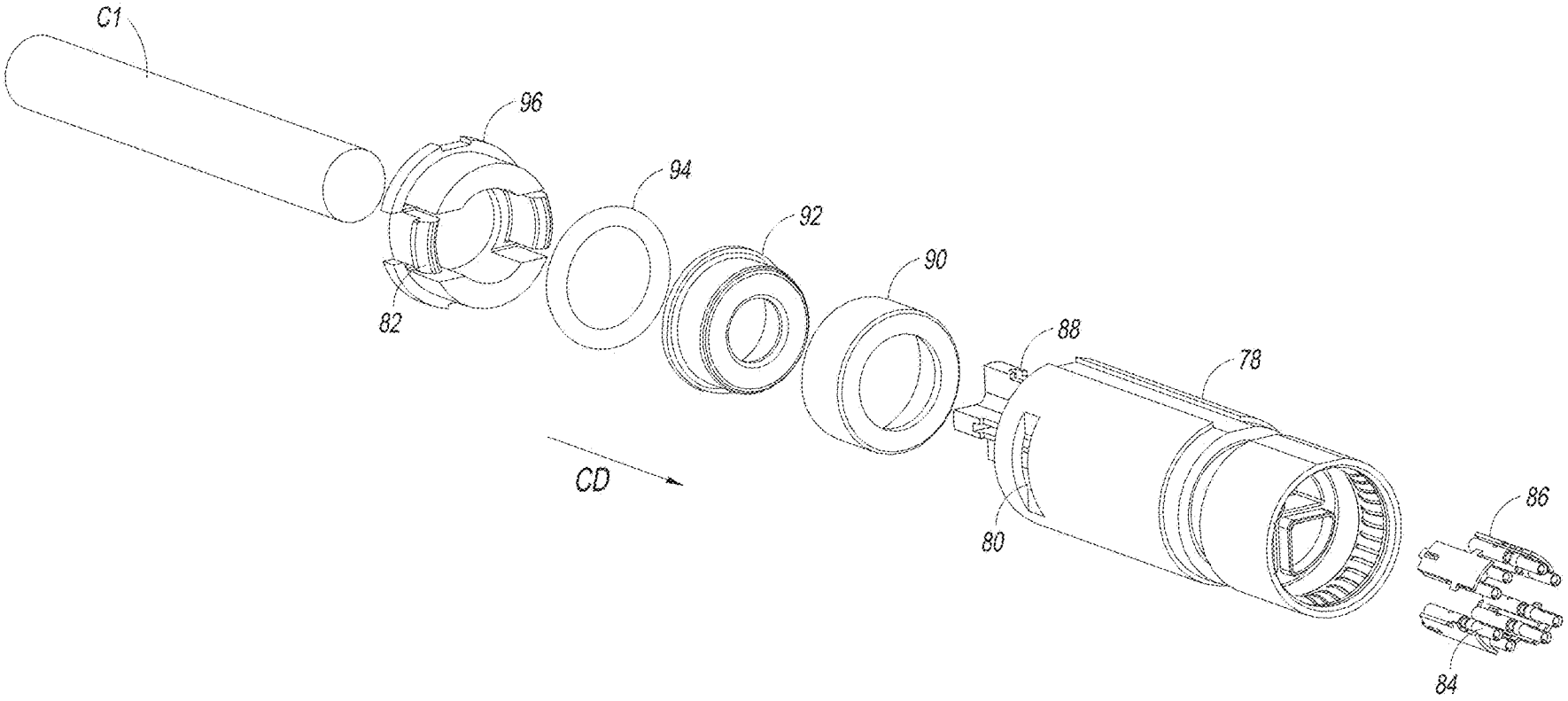
FIG. 17 illustrates an exploded perspective view of the socket of FIG. 16.

As shown in the exploded view of FIG. 17, the socket 22 includes one or more contacts 84, such as female contacts configured to receive male contacts of the pin 24. The socket 22 can include one or more securing doors 86, which can be shaped as sectors of a cylinder. The socket 22 can include an inner body 88, which can receive the contacts 84 and the securing doors 86. The securing door 86 can be configured to be removed from the inner body 88, such as during installation or removal of the contacts 84 into or out of the inner body 88. The inner body 88 can be received in the outer body 78. In some embodiments, a shoulder of the inner body 88 is engaged against a shoulder or other structure of the outer body 78, which stops the inner body 88 from being moved out of the outer body 78 in the coupling direction CD. The end of the inner body 88 having the contacts 84 can be exposed in the coupling direction CD to allow engagement with the pin 24.

In some implementations, the socket 22 can include a compression sleeve 90 and a support sleeve 92. Some embodiments can include a gasket 94, such as an O-ring. In some embodiments, the socket 22 includes a retention cap 96. In some embodiments in the assembled socket 22, the O-ring is compressed longitudinally between the retention cap 96 and an end of the support sleeve 92. In certain implementations, the compression sleeve 90 is received over a reduced diameter portion of the support sleeve 92. The reduced diameter portion can be tapered. The compression sleeve 90 can be fit onto the reduced diameter portion with an interference fit.

As shown, the retention cap 96 can include the locking mechanism 82 that engages with the corresponding locking mechanism 80 of the outer body 78. This can secure the socket 22 together and maintains the inner body 88, compression sleeve 90, support sleeve 92, and gasket 94 in the outer body 78. In the embodiment illustrated, the locking mechanisms 80, 82 comprise a tooth and a window that receives the tooth. In some embodiments, the locking mechanisms 80, 82 comprise mating threads, interference fit, tongue and groove structure, or otherwise.

Figure 18:
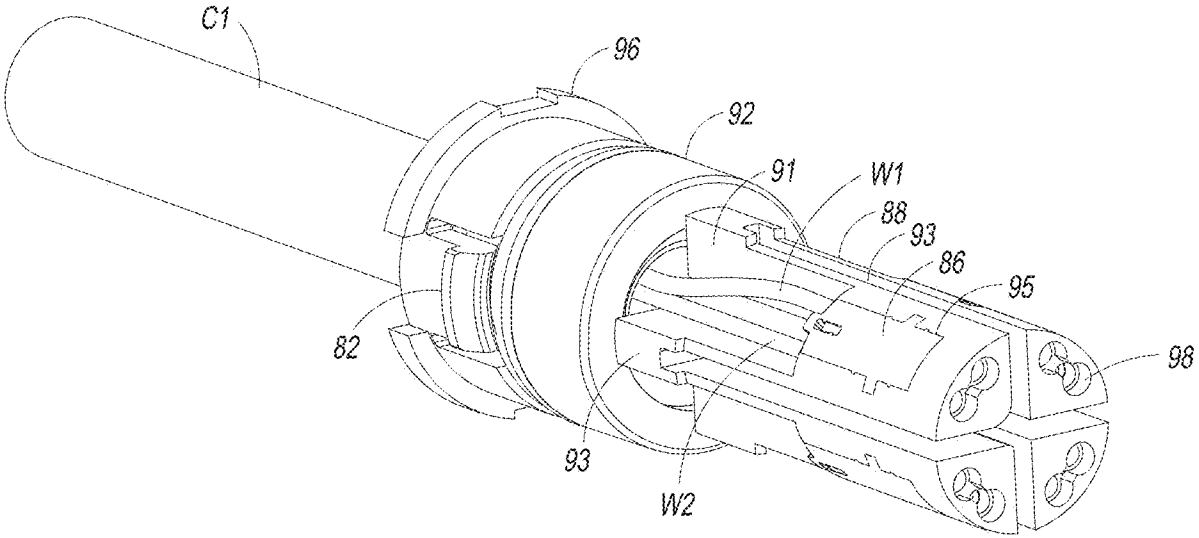
FIG. 18 illustrates a perspective view of a portion of the socket of FIG. 16, with an outer body not shown.

As shown in FIG. 18, an embodiment of the socket 22 is illustrated with the outer body 78 not shown for purposes of presentation. As illustrated, the inner body 88 can include channels 91 for receiving wires from the first cable C1. In the embodiment illustrated, two wires W1, W2 are routed through each of the channels 91. In some variants, each of the channels 91 carries 1, 3, 4, or more wires. As shown, the channels 91 can comprise a sector and/or angle around the circumference of the inner body 88, such as a sector or angle of at least about: 45°, 60°, 90°, 120°, 135°, 180°, values between the aforementioned values, or other values. The channels 91 can be separated (e.g., bounded circumferentially) by walls 93 of the inner body 88.

As previously mentioned, the securing doors 86 can be received in the inner body 88. For example, the securing doors 86 can be received in corresponding openings 95 around the circumference of the inner body 88. The securing doors 86 can be secured to the inner body 88 with a friction fit, latch, adhesive, hinge, or otherwise. As shown, in some embodiments, the securing doors 86 are shaped as a sector of the circumference of the inner body 88. The illustrated embodiment comprises four doors, though other numbers of securing doors 86 are contemplated, such as 1, 2, 3, 5, 6, or more. In some embodiments, the securing doors 86 are substantially equally spaced around the circumference of the inner body 88.

Figure 19:
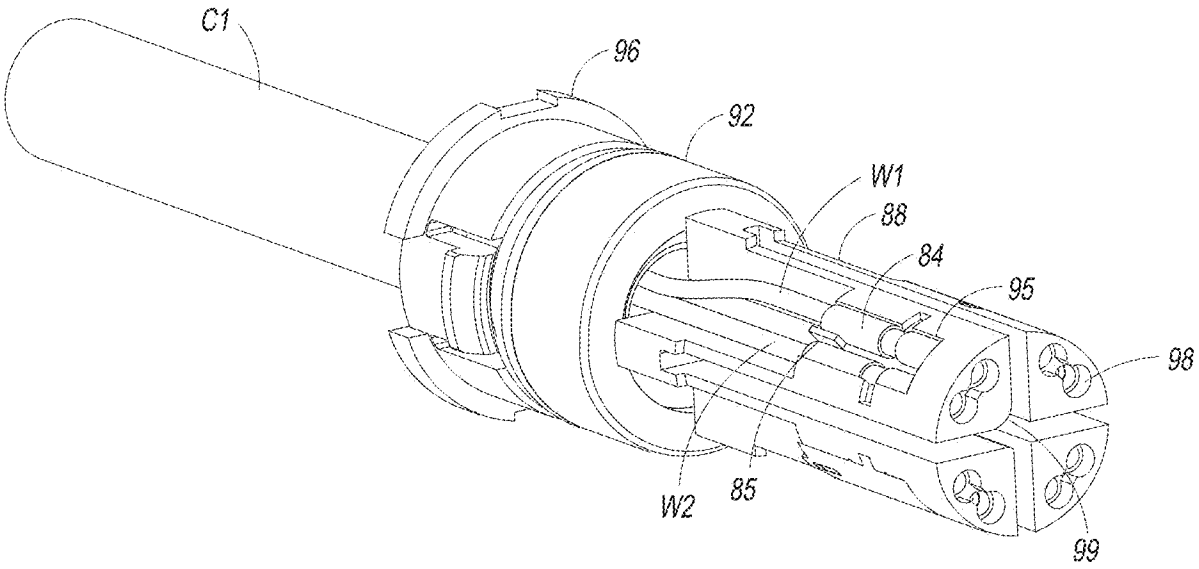
FIG. 19 illustrates a perspective view of a portion of the socket of FIG. 16, with an outer body and a securing door not shown.

FIG. 19 illustrates the socket 22 with both the outer body 78 and one of the securing doors 86 not shown for purposes of the presentation. As shown, the individual wires of the first cable C1 connect to a corresponding one of the contacts 84, which is located in the inner body 88. Each of the contacts 84 is located in a respective aperture 98 on an end of the inner body 88. The aperture 98 is configured to receive a male contact of the pin 24. The contacts 84 can be spaced apart by a spacing element, such as a rib 85. As illustrated, without the securing door 86 installed on the inner body 88, the contacts 84 are radially accessible. For example, in the embodiment shown, with one securing door 86 removed two of the contacts 84 are accessible, such as for installation into or removal out of the inner body 88. In some embodiments, the securing doors 86 are receiving in and/or obstruct (e.g., close) the openings 95 in the radial direction. In some embodiments, the inner body 88 includes mounts that receive and/or secure the contacts 84 in the inner body 88. In some embodiments, one or more of the mounts is configured to be deflected during engagement of the contact 84 with the mount. In some implementations, the mounts comprise a generally "U" shaped structure.

In some embodiments, the socket 22 is configured to facilitate engagement with the pin 24 only in a certain orientation. For example, as illustrated, an end of the socket 22 can include an orienting feature 99, such as a rounded corner that is different from other corners of the socket 22. The pin 24 can have a corresponding orientation feature. This can enable the pin 24 and socket 22 to be coupled together in only one circumferential orientation, thereby facilitating proper engagement between the contacts of the socket 22 and the contacts of the pin 24. For example, the orientation feature 99 can ensure that contact number one of the socket 22 only mates with contact number one of the pin 24, contact number two of the socket 22 only mates with contact number two of the pin 24, etc.

Pin (FIGS. 20-23)

Figure 20:
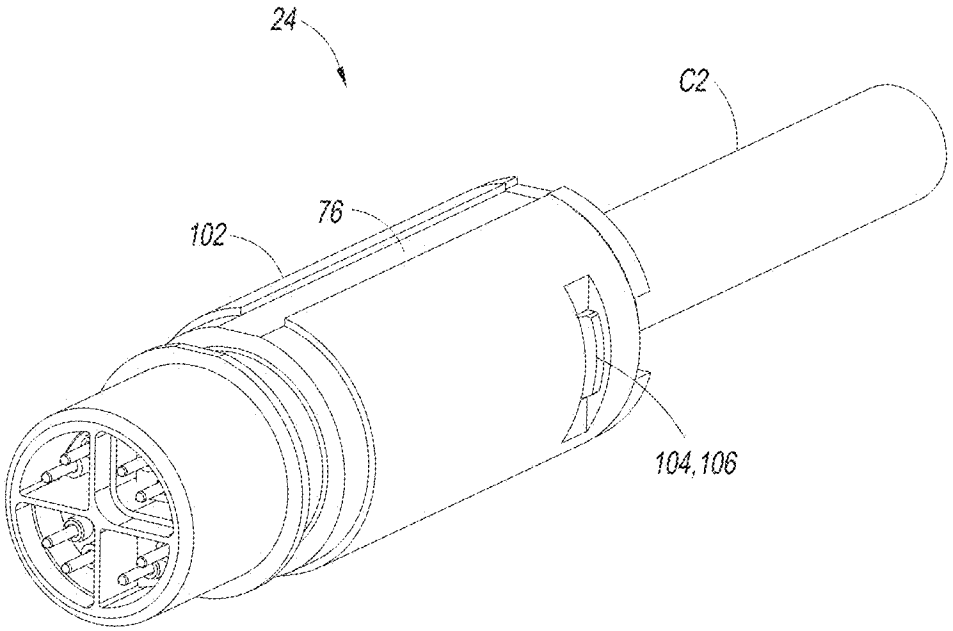
FIG. 20 illustrates a perspective view of a pin of the connection unit of FIG. 15.

FIG. 20 illustrates an example of the pin 24. In some embodiments, the pin 24 comprises an outer body 102, which can include the orientation feature 74 discussed above. As shown, the outer body 102 can include a locking mechanism 104, which can engage with a corresponding locking mechanism 106 to secure the pin 24 together as a unit, as will be discussed below.

Figure 21:
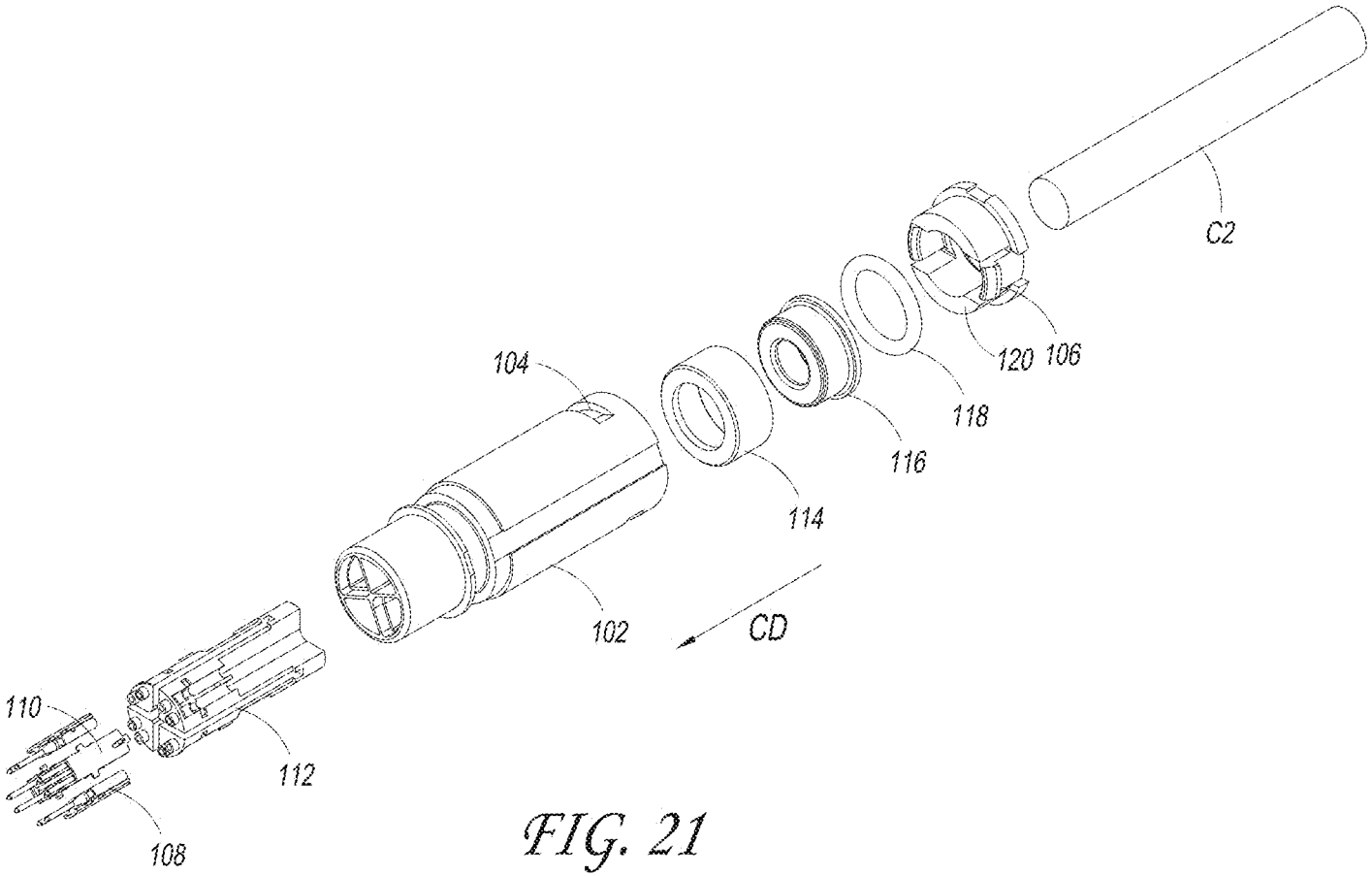
FIG. 21 illustrates an exploded perspective view of the pin of FIG. 20.

As shown in the exploded view of FIG. 21, the pin 24 includes one or more contacts 108, such as male contacts configured to be received in female contacts of the socket 22. The pin 24 can include one or more securing doors 110, which can be shaped as sectors of a cylinder. The pin 24 can include an inner body 112, which can receive the contacts 108 and the securing doors 110. The inner body 112 can be received in the outer body 102. In some embodiments, a shoulder of the inner body 112 is engaged against a shoulder or other structure of the outer body 102, which stops the inner body 112 from being moved out of the outer body 102 in the coupling direction CD. The end of the inner body 112 having the contacts 108 can be exposed in the coupling direction CD to allow engagement with the socket 22.

In some implementations, the pin 24 can include a compression sleeve 114 and a support sleeve 116. Some embodiments can include a gasket 118, such as an O-ring. In some embodiments, the pin 24 includes a retention cap 120. In some embodiments in the assembled pin 24, the O-ring is compressed longitudinally between the retention cap 120 and an end of the support sleeve 116. In certain implementations, the compression sleeve 114 is received over a reduced diameter portion of the support sleeve 116. The reduced diameter portion can be tapered. The compression sleeve 114 can be fit on the reduced diameter portion with an interference fit.

As shown, the retention cap 120 can include the locking mechanism 106 that engages with the corresponding locking mechanism 104 of the outer body 102. This can secure the pin 24 together and maintains the inner body 112, compression sleeve 114, support sleeve 116, and gasket 118 in the outer body 102. In the embodiment illustrated, the locking mechanisms 104, 106 comprise a tooth and a window that receives the tooth. In some embodiments, the locking mechanisms 104, 106 comprise mating threads, interference fit, tongue and groove structure, or otherwise.

Figure 22:
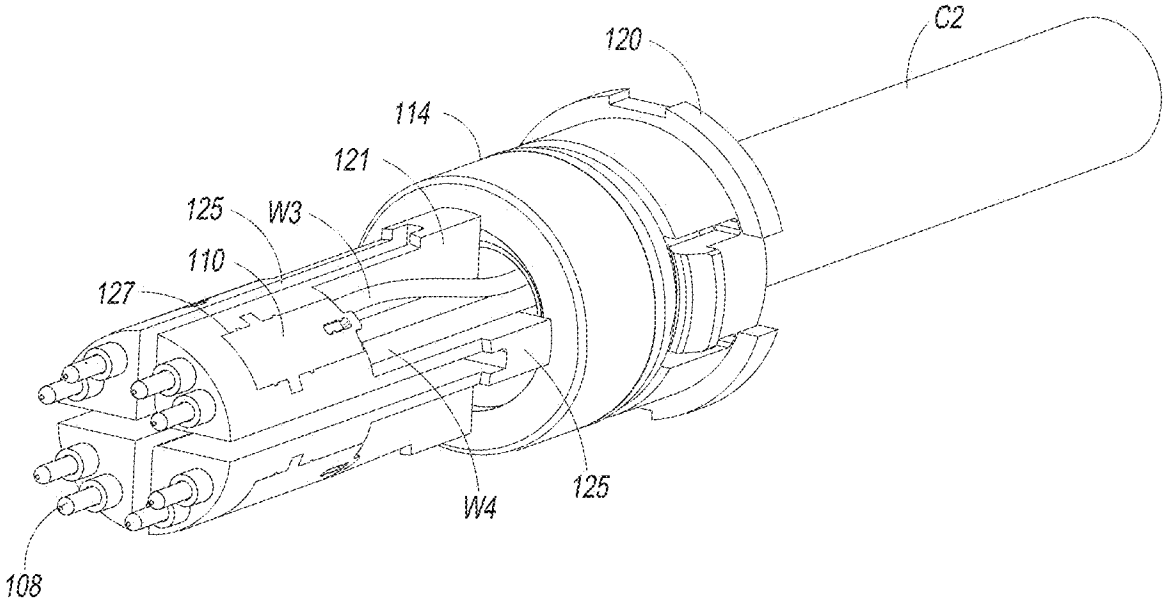
FIG. 22 illustrates a perspective view of a portion of the pin of FIG. 20, with an outer body not shown.

As shown in FIG. 22, an embodiment of the pin 24 is illustrated with the outer body 102 not shown for purposes of presentation. As illustrated, the inner body 112 can include channels 121 for receiving wires from the second cable C2. In the embodiment illustrated, two wires W3, W4 are routed through each of the channels 121. In some variants, each of the channels 121 carries 1, 3, 4, or more wires. As shown, the channels 121 can comprise a sector and/or angle around the circumference of the inner body 112, such as a sector or angle of at least about: 45°, 60°, 90°, 120°, 135°, 180°, values between the aforementioned values, or other values. The channels 121 can be separated (e.g., bounded circumferentially) by walls 125 of the inner body 112.

As previously mentioned, the securing doors 110 can be received in the inner body 112. For example, the securing doors 110 can be received in corresponding openings 127 around the circumference of the inner body 112. The securing doors 110 can be secured to the inner body 112 with a friction fit, latch, adhesive, hinge, or otherwise. As shown, in some embodiments, the securing doors 110 are shaped as a sector of the circumference of the inner body 112. The illustrated embodiment comprises four doors, though other numbers of securing doors 110 are contemplated, such as 1, 2, 3, 5, 6, or more. In some embodiments, the securing doors 110 are substantially equally spaced around the circumference of the inner body 112.

Figure 23:
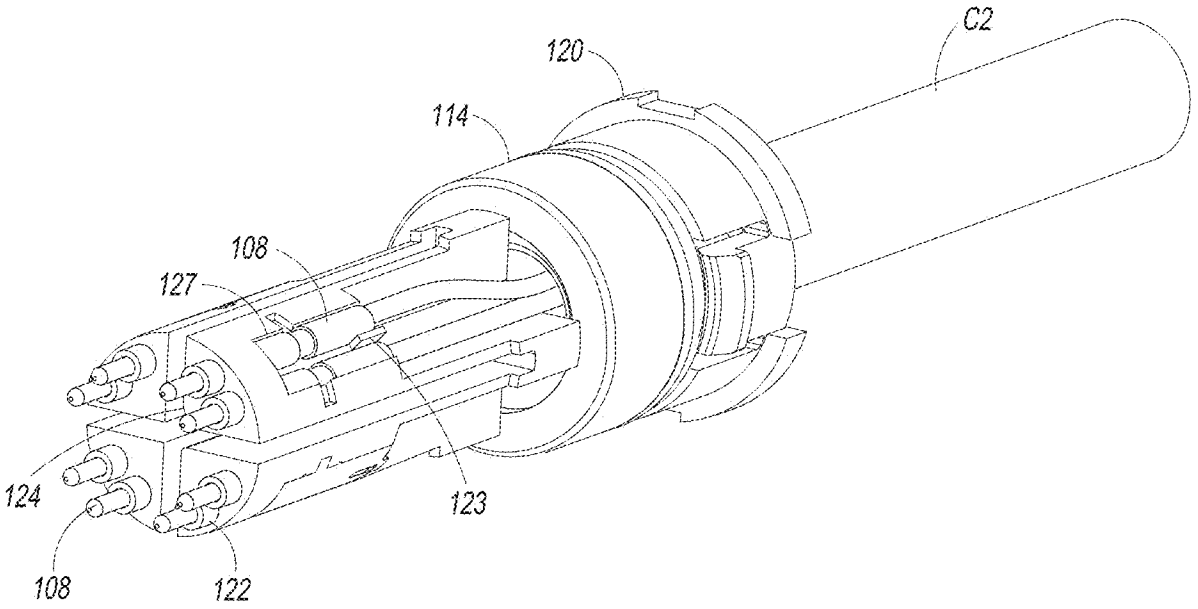
FIG. 23 illustrates a perspective view of a portion of the pin of FIG. 20, with an outer body and a securing door not shown.

FIG. 23 illustrates the socket 22 with both the outer body 102 and one of the securing doors 110 not shown for purposes of the presentation. As shown, the individual wires of the second cable C2 connect to a corresponding one of the contacts 108, which is located in the inner body 112. Each of the contacts 108 extends through a respective aperture 122 on an end of the inner body 112. The contacts 108 can comprise male contact portions that are configured to be received in the apertures 98 of the socket 22 and to engage with the contacts 84 of the socket 22. The contacts 108 of the pin 24 can be spaced apart by a spacing element, such as a rib 123. As illustrated, without the securing door 110 installed on the inner body 112, the contacts 108 are radially accessible. For example, in the embodiment shown, with one securing door 110 removed two of the contacts 108 are accessible, such as for installation into or removal out of the inner body 112. In some embodiments, the inner body 112 includes mounts that receive and/or secure the contacts 108 in the inner body 112. In some embodiments, one or more of the mounts is configured to be deflected during engagement of the contact 108 with the mount. In some implementations, the mounts comprise a generally "U" shaped structure.

In some embodiments, the pin 24 is configured to facilitate engagement with the socket 22 only in a certain orientation. For example, as illustrated, an end of the pin 24 can include an orienting feature 124, such as a rounded corner that is different from other corners of the pin 24. As mentioned above, the socket 22 can have a corresponding orientation feature. This can enable the pin 24 and socket 22 to be coupled together in only one circumferential orientation, thereby facilitating proper engagement between the contacts of the socket 22 and the contacts of the pin 24.

Additional Examples (FIGS. 24-27)

Figure 24:
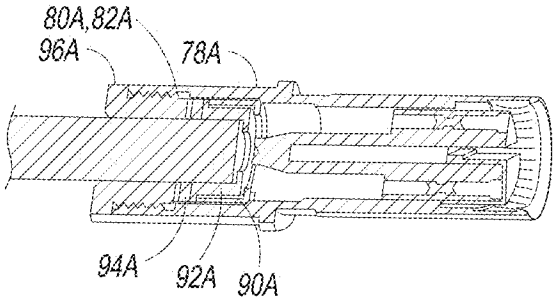
FIG. 24 illustrates a perspective cross-sectional view of another embodiment of a socket that can be used in the connection unit of FIG. 15.

FIG. 24 illustrates another example of a socket 22A. As shown, the socket 22A includes a body 78A and a retention cap 96A. The body 78A and the retention cap 96A are secured together with securing features 80A, 82A, such as mating threads. The threaded engagement between the body 78A and the retention cap 96A can compress a gasket 94A, such as an O-ring, against a support sleeve 92A and/or a compression sleeve 90A. The socket 22A can include any of the features of the socket 22 discussed above.

Figure 25:
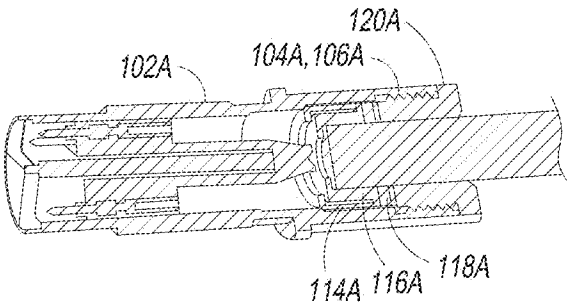
FIG. 25 illustrates a perspective cross-sectional view of another embodiment of a pin that can be used in the connection unit of FIG. 15.

FIG. 25 illustrates another example of a pin 24A. As illustrated, the pin 24A includes a body 102A and a retaining cap 120A. The body 102A and the retaining cap 120A can include mating securing structures 104A, 106A, such as threads. The threaded engagement between the body 102A and the retaining cap 120A can longitudinally compress a gasket 118A, such as an O-ring, against a support sleeve 116A and/or a compression sleeve 114A. The pin 24A can include any of the features of the pin 24 discussed above.

Figure 26:
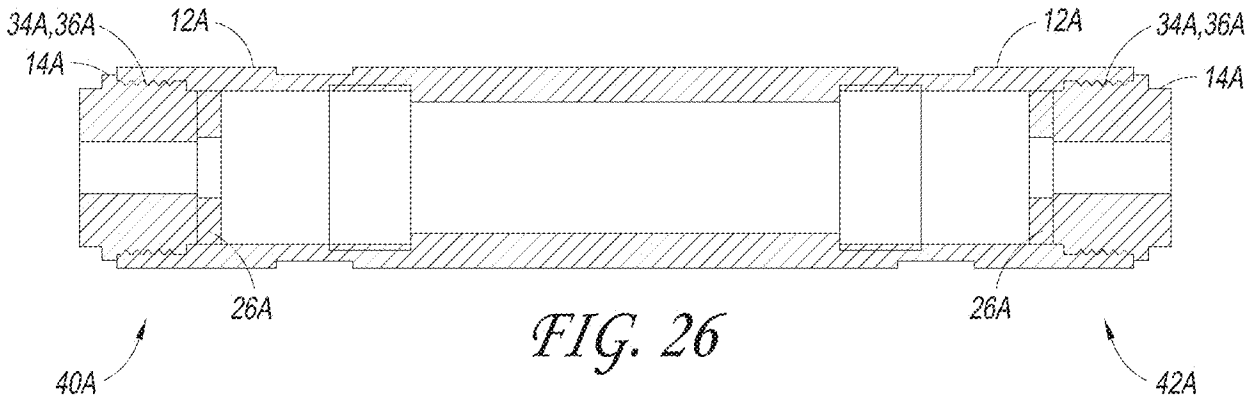
FIG. 26 illustrates a side cross-sectional view of another embodiment of a housing that can be used in the splice connector assembly of FIG. 1.

FIG. 26 illustrates another example of a housing 12A. As shown, the housing 12A includes a first end 40A and a second end 42A. The ends 40A, 42A can include securing features 36A, such as threads, on an internal surface of the housing 12. As shown, a coupling nut 14A can be connected to each end 40A, 42A. The coupling nut 14A can include corresponding securing features 34A, such as mating threads on an exterior of the coupling nut 14A. This can enable the coupling nut 14A to threadably engage into the housing 12A. In some embodiments, the coupling nut 14A longitudinally compresses a sealing gland 26A, such as against an end of a connection unit (not shown) received in the housing 12A. In some embodiments, an exterior of the housing 12A is substantially smooth. In some embodiments, as illustrated in FIG. 26, the housing 12A includes channels on an exterior, which can facilitate gripping 24 and/or mounting of the housing 12A. The housing 12A can include any of the features of the housing 12 discussed above.

Figure 27:
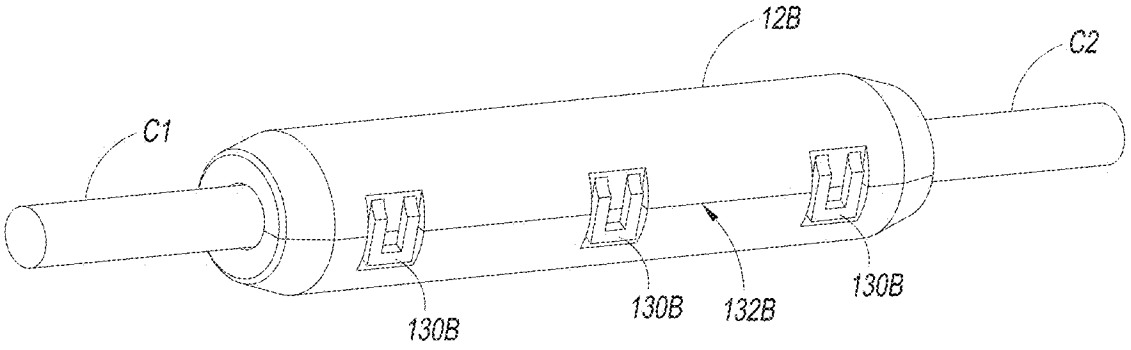
FIG. 27 illustrates a perspective view of another embodiment of a housing that can be used in the splice connector assembly of FIG. 1.

FIG. 27 illustrates another example of a housing 12B, which comprises a clamshell configuration. The housing 12B can include latches 130B on one circumferential side of the housing 12B and a hinge (not shown) on substantially the opposite circumferential side. As illustrated, a gap or seam 132B can longitudinally extend along the side with the latches 130B. In some embodiments, the housing 12B includes multiple latches 130B, such as three latches. Certain embodiments have more or fewer latches such as 1, 2, 4, 5, or more. When the latches are unfastened, the housing 12B can be opened to install or remove a connection unit (not shown). The housing 12B can include any of the features of the housing 12 discussed above.

Figure 28:
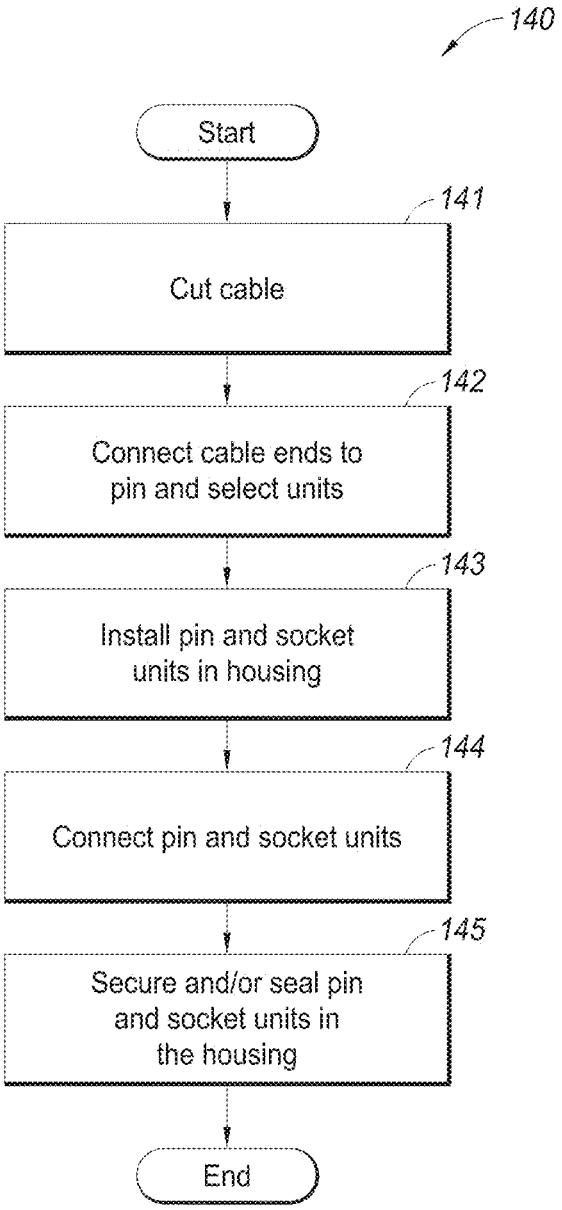
FIG. 28 schematically illustrates a method of using a splice connector assembly.
Figure 29:
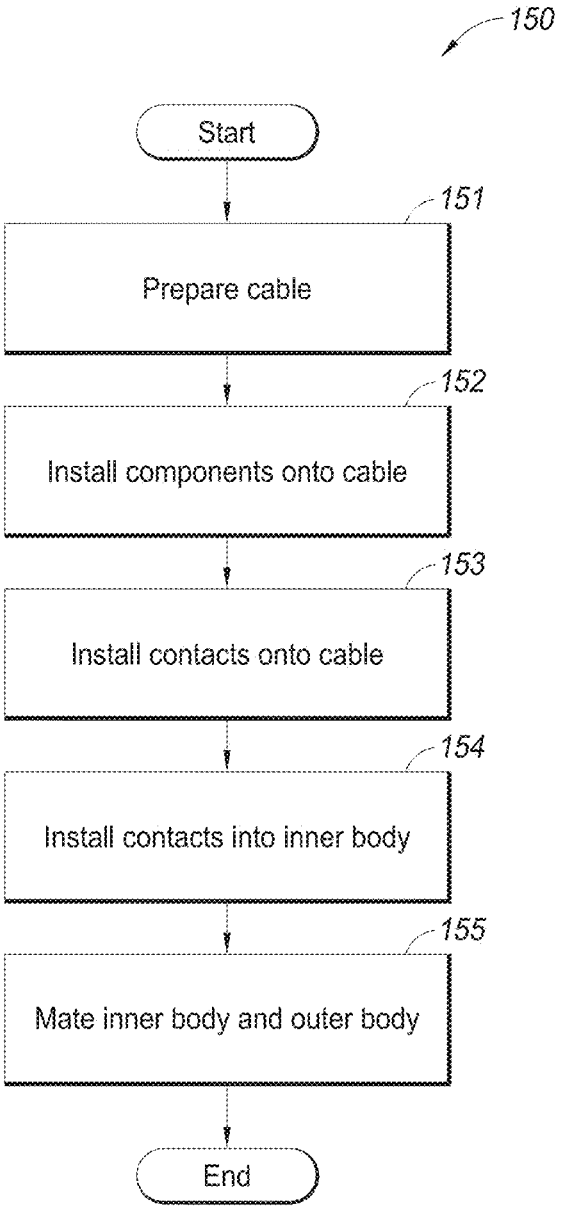
FIG. 29 schematically illustrates a method of connecting cable ends to a socket and a pin of a splice connector assembly.

Certain Methods Related to the Splice Connector Assemblies (FIGS. 28 and 29)

The scope of the present disclosure includes relevant methods associated with the splice connector assembly 10. For example, this disclosure includes methods of using, assembly, disassembly, and/or installation of the splice connector assembly 10.

FIG. 28 schematically illustrates a method 140 related to the splice connector assembly, such as a method of splicing a cable. As shown, in some embodiments, the method begins with cutting a cable 141. For example, the method can include cutting an end of a first cable and/or an end of a second cable. In some embodiments, the method includes cutting a cable to produce the two cable ends. In certain implementations, the cable is a multi-conductor cable, such as a cable with a plurality of individual insulated wires. In some embodiments, the cable is an Ethernet cable.

In some embodiments, the method includes connecting the cable ends 142 to components of the splice connector assembly. For example, the method can include connecting the end of the first cable to the socket and the end of the second cable to the pin, as discussed in more detail below.

The method can include installing the pin and socket into the housing 143. In some embodiments, the pin and socket are installed longitudinally into the housing. In certain variants, the pin and socket are installed radially into the housing, such as through a clamshell housing in an open configuration.

The method can include orienting the pin and/or socket relative to an orientation feature on the housing. For example, the method can include aligning an orientation feature of the pin and/or socket with a corresponding orientation feature of the housing. Some embodiments include aligning an orientation feature of the pin and/or socket with a housing orientation indicator, which is aligned with a housing orientation feature. In some implementations, the method includes engaging an orientation feature of the housing with an orientation feature of the socket and/or pin. For example, the method can include receiving a protrusion (e.g., a rib) of the housing into a corresponding groove of the socket and/or pin, or receiving a protrusion of the socket and/or pin into a corresponding groove of the housing. The method can include sliding the protrusion along the groove.

The method can include coupling the pin and socket 144. This can provide connectivity between the first and second cable. For example, the method can include inserting male contacts of the pin into female contacts of the socket. In some implementations, the coupling of the pin and socket occurs inside the housing. For example, the socket can be inserted into a first end of the housing and the pin can be inserted into a second end of the housing, and the socket and pin can meet and couple inside the housing. In some implementations, the socket and pin are blind-mated inside the housing, such as the coupling occurring without a user seeing the mating ends of the socket and pin. In certain variants, the socket and pin are coupled outside the housing, and the coupled socket and pin are installed into the housing.

In some embodiments, the method includes installing a sealing gland on each cable end. The sealing gland can be positioned adjacent to an outer end of the socket and/or pin. The method can include abutting a radially outer rib of the sealing gland with an inside of the housing. The method can include abutting a radially inner rib, or a plurality of radially inner ribs, of the sealing gland with the cable. The sealing gland can include an aperture with a shape that approximately corresponds to the share of the cable. For example, the cable can be elliptical and the aperture can be elliptical. In some embodiments, the cable and aperture have a non-concentric shape.

The method can include installing a washer on each cable end. The washer can be installed adjacent to the sealing gland. In some embodiments, the method includes engaging features of the washer with corresponding features of the housing. In some implementations, the mating features comprise flanges and recesses. For example, the method can include receiving flanges of the washer in recesses of the housing and/or recesses of the washer in flanges of the housing. In some variants, the mating features comprise teeth, shoulders, or otherwise. The mating features can be configured to inhibit or prevent the washer from rotating relative to the housing. The method can include keeping the washer substantially stationary in the circumferential direction relative to the housing.

The method can include securing and/or sealing the pin and socket in the housing 145. In some embodiments, the method includes installing a coupling nut with the housing, such as by threading a coupling nut onto each end of the housing. Certain implementations include engaging features to inhibit or reduce the chance of unintentional loosening of the coupling nut. For example, the method can include engaging anti-rotation features of the coupling nut with corresponding rotation features of the washer. In some embodiments, the anti-rotation features comprise ribs, teeth, grooves, or otherwise.

The method can include compressing the seal. This can cause the sealing gland to seal around the cable, such as a substantially liquid-tight or substantially air-tight seal. In some embodiments, the coupling nut moves longitudinally relative to the housing as the coupling nut threads onto the housing. The movement of the coupling nut can press the washer longitudinally, which compresses the sealing gland longitudinally between the washer and an end of the socket or pin. In some implementations, the compression of the sealing gland causes the sealing gland to expand radially inwardly and/or the opening in the sealing gland to decrease in diameter. This can result in the sealing gland sealing around the cable. In various embodiments, the method includes applying substantially only a longitudinal force to the seal. In some embodiments, the method includes applying substantially no torque to the seal. Certain embodiments include converting a rotational force of the coupling nut into a longitudinal force applied to the seal.

FIG. 29 schematically illustrates a method 150 of connecting the cable ends to the socket and pin. In some embodiments, the method includes preparing the cable 151. Preparing the cable can include installing the retention cap and/or O-ring onto the cable. Cable preparation can include measuring and/or cutting away a portion of the cable jacket and/or shielding. In some embodiments, the method includes cutting away more of the insulation than the shielding. For example, the shielding can be allowed to extend toward the cut end of the cable a greater length than the jacket.

In some embodiments, the method includes installing components of the splice connector assembly 10 onto the cable 152. For example, the method can include installing a coupling nut, washer, and/or sealing gland onto the cable. The cable can extend through openings in the coupling nut, washer, and/or seal. In some embodiments, the method includes installing a support sleeve onto the cable, such as over wires and shielding of the cable. In some embodiments, the method includes splaying the shielding radially outward and/or bending the shielding over the support sleeve. The method can include installing the compression sleeve over the support sleeve. In some embodiments, this includes binding and/or retaining a portion of the shielding between the retaining sleeve and the compression sleeve. The compression sleeve can be retained on the support sleeve, such as with a friction fit.

In some embodiments, the method includes installing contacts onto the wires. For example, the method can include stripping ends of the wires to expose conductors of the wires. The method can include installing (e.g., crimping) contacts of the pin and socket onto the exposed wires 153. For example, the method can include installing one contact onto each exposed wire.

In some embodiments, the method includes installing the contacts into the inner bodies of the pin and socket 154. For example, the method can include removing the securing doors on the inner body to reveal chambers configured to receive the contacts. The method can include installing the contacts into the chambers. In some embodiments, a plurality of contacts (e.g., two, three, four, or more) are installed in each chamber. The inner body can be marked or otherwise provided with indicators or indicia to indicate which wire of the cable should be installed in which chamber. The method can include securing the contacts in the inner body. For example, the method can include installing doors over the chambers and securing the doors to the inner body, such as with a friction fit, detent, or otherwise.

In various embodiments, the method can include mating the inner body with an outer body 155. For example, in some embodiments, the inner body is longitudinally slid into the outer body. In certain implementations, the inner body is radially installed into the outer body. In some variants, the inner body and outer body are threaded together.

The method can include securing the inner body and outer body. For example, as previously discussed, the outer body can have a locking mechanism that engages with a corresponding locking mechanism of the retaining cap, thereby securing the inner body in the outer body. For example, the outer body and the retaining cap can have an engaging tooth and window, threads, interference fit, or otherwise. Some embodiments include sealing an end of the inner body. In some embodiments, the method includes compressing a gasket, such as an O-ring, between the retaining cap and the support sleeve, thereby providing a seal.

Figure 30:
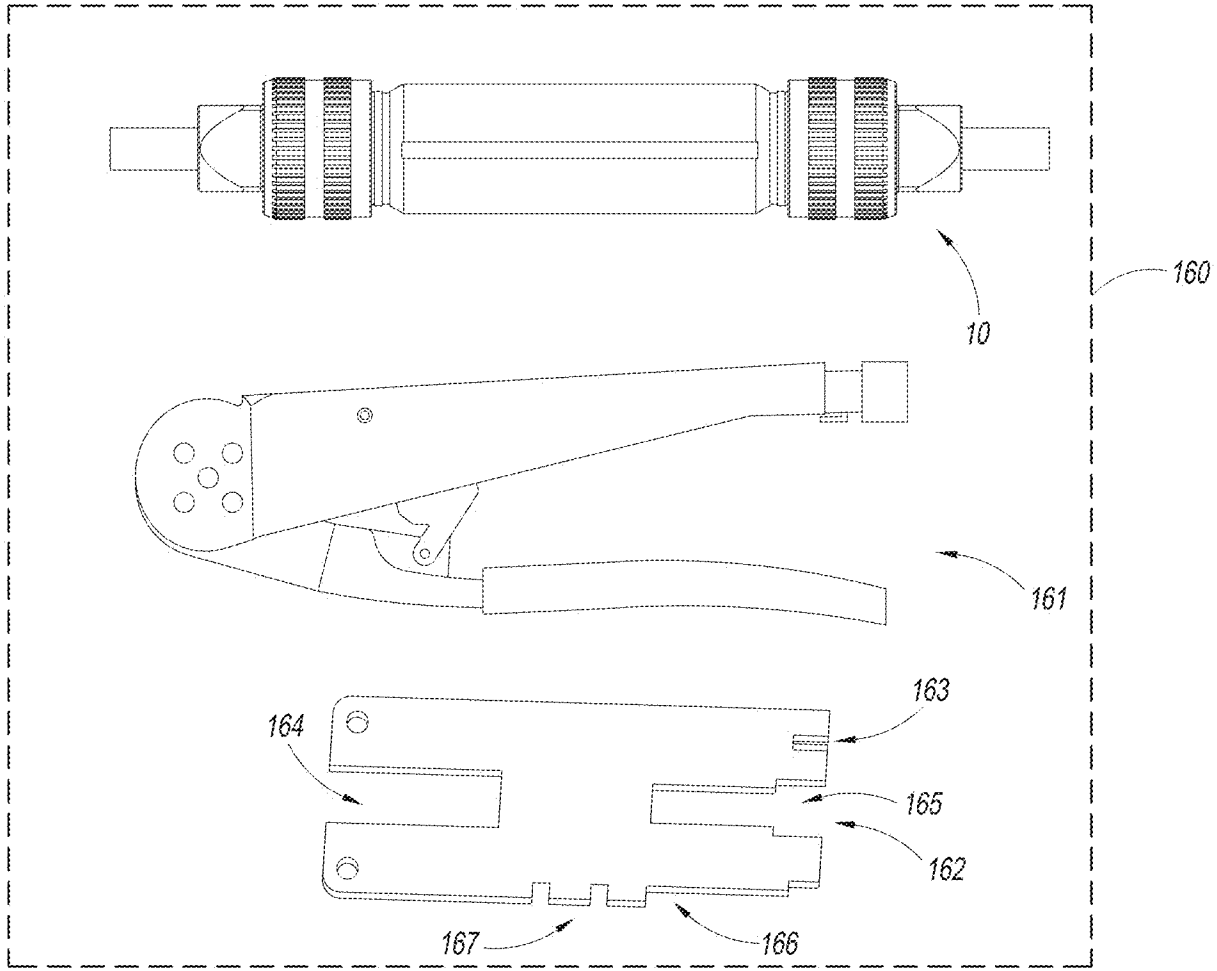
FIG. 30 schematically illustrates a kit comprising a splice connector assembly.

Certain Kits (FIG. 30)

FIG. 30 schematically illustrates an example of a splicing kit 160. As shown, the splicing kit 160 can comprise the splice connector assembly 10, a crimping tool 161, and a wire preparation tool 162. The crimping tool can be configured to crimp the contacts 84, 108 onto ends of the wires of the cables C1, C2.

The wire preparation tool 161 can be configured to aid a user in preparing the cables C1, C2 for installation with the socket 22 and pin 24. As discussed above, such preparation can include, for example, cutting various components of the cables C1, C2 to length. The wire preparation tool 162 can provide a ready guide for such lengths for the various components of the cables. In some embodiments, the wire preparation tool 162 comprises channels of the appropriate length for the different components of the cables. For example, as illustrated, the wire preparation tool 162 can include a first channel 163 with a first length for indicating the length to strip the insulation from the conductor (e.g., wire). The wire preparation tool 162 can include a second channel 164 with a second length for indicating the length to strip the jacket from the cable. The wire preparation tool 162 can include a third channel 165 with a third length for indicating the braid removal length and/or a fourth channel 166 with a fourth length for indicating the foil removal length. Some embodiments include a gauge 167, which can indicate the size of conductor, such as 24 AWG, 26 AWG, or otherwise. In some embodiments, the cable preparation tool 161 comprises a substantially flat and/or rigid sheet of material, such as a metal.

Certain Multi-Part Housings (FIGS. 31-37)

Figure 31:
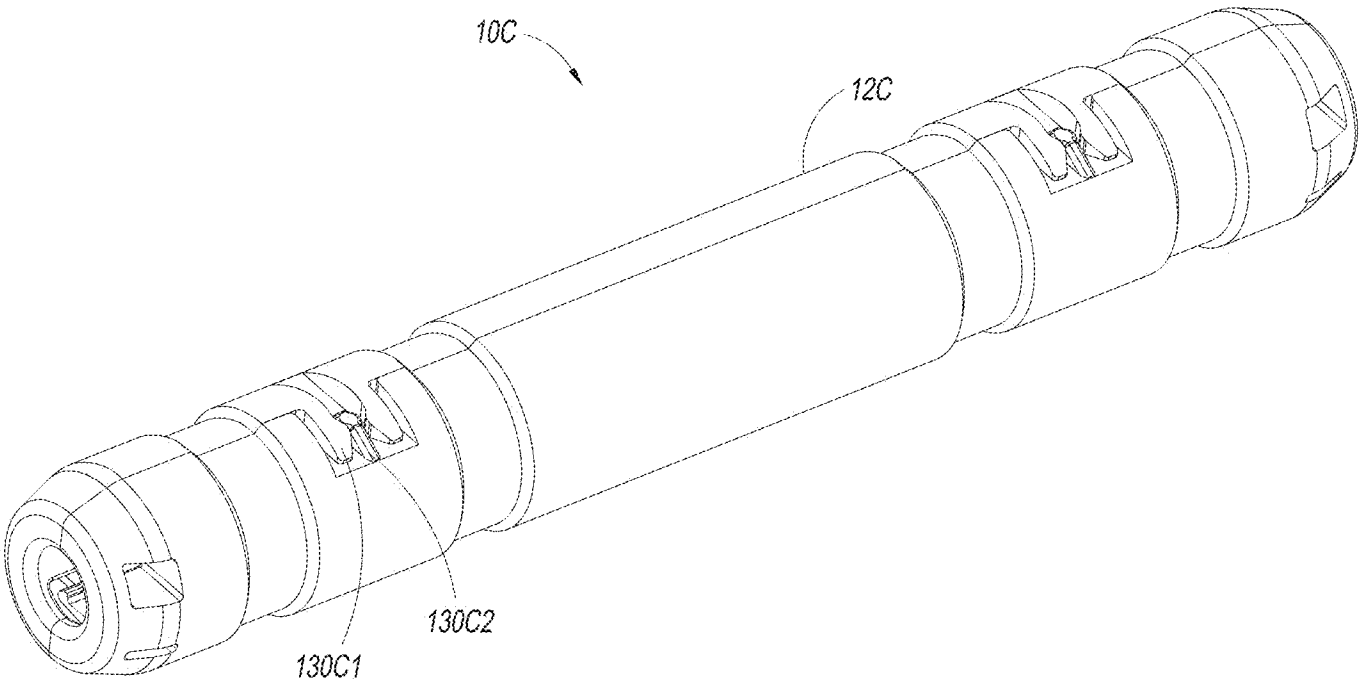
FIG. 31 illustrates a perspective view of another embodiment of a splice connector assembly, the assembly comprising a multi-part housing.

FIG. 31 illustrates another embodiment of a splice connector assembly 10C. As shown the splice connector assembly 10C can include a housing 12C. In various embodiments, the housing 12C comprises a plurality of housing portions, such as two, three, four, five, or more housing portions. In some embodiments, the housing 12C comprises two halves (e.g., a first housing portion and a second housing portion). In some embodiments, the housing 12C comprises three thirds. In some embodiments, the housing 12C comprises four quarters. In some embodiments, the housing portions are about equal in size. For example, in some variants of the housing 12C, each of the housing portions extends circumferentially approximately the same amount. In certain variants, the housing portions are about unequal in size.

The housing portions can be configured to mate (e.g., circumferentially) to form the housing 12C. As shown, the housing 12C can include connection members, which can facilitate the mating. In certain implementations, the connection members comprise latches 130C1 and/or protrusions 130C2. As shown, the protrusion 130C2 can be received between the latches 130C1, such as with a friction fit. This can secure the protrusion 130C2 in the latches 103C1. In several embodiments, the connection members facilitate securing the parts of the multi-part housing 12C together.

In some embodiments, the housing portions are configured to mate with themselves. Certain embodiments are configured such that a similar or identical housing portion can be mated with another instance of that housing portion. For example, some embodiments are configured such that a first housing portion can be rotated about 180 degrees about the axis A1, A2 and mated with a similar or identical version of the housing portion to form the housing 12C. In several embodiments, the housing portion is substantially symmetrical, such as about the axis A1 and/or the axis A2. In some implementations, the housing portion is substantially symmetrical about a horizontal and/or vertical axis.

Figure 32:
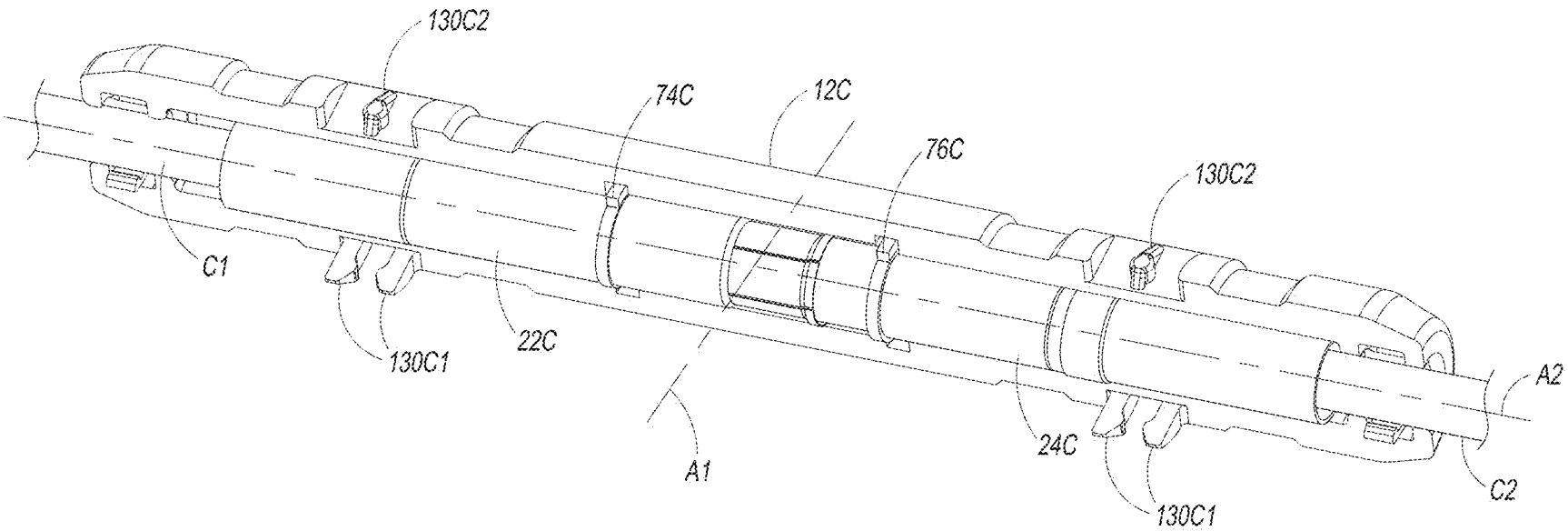
FIG. 32 illustrates a perspective view of the splice connector assembly of FIG. 31 with a portion of the multi-part housing removed.

As shown in FIG. 32, the splice connector assembly 10C can include a socket 22C and pin 24C. The socket 22C and pin 24C can fit within the housing 12C and can be retained and/or secured therein. The housing 12C can include a cavity that receives the socket 22C and pin 24C. In some embodiments, the housing 12C is configured such that the socket 22C and the pin 24C can be received in either end of the cavity. For example, in certain variants, a first end of the cavity can receive the socket 22C and a second end of the cavity can receive the pin 24C, or vice versa. The socket 22C and pin 24C can respectively connect with cables C1, C2, as described above. The socket 22C and pin 24C can couple together to provide electrical connectivity between the cable C1, C2. As illustrated, in some embodiments, the latches 130C1 comprise elongate members, such as arms or fingers. In some embodiments, the latches 130C1 extend generally tangentially relative to a circumference of the housing 12C. In some embodiments, the protrusion 130C2 extends radially relative to the housing 12C. As shown, the connection members (e.g., latches 130C1 and protrusion 130C2) can be located on circumferentially opposite ends of the housing portion. In some implementations, on a housing portion, the connection members are about 180° offset from each other in the circumferential direction. In some implementations, each axial end of the housing portion includes the connection members.

Figure 33:
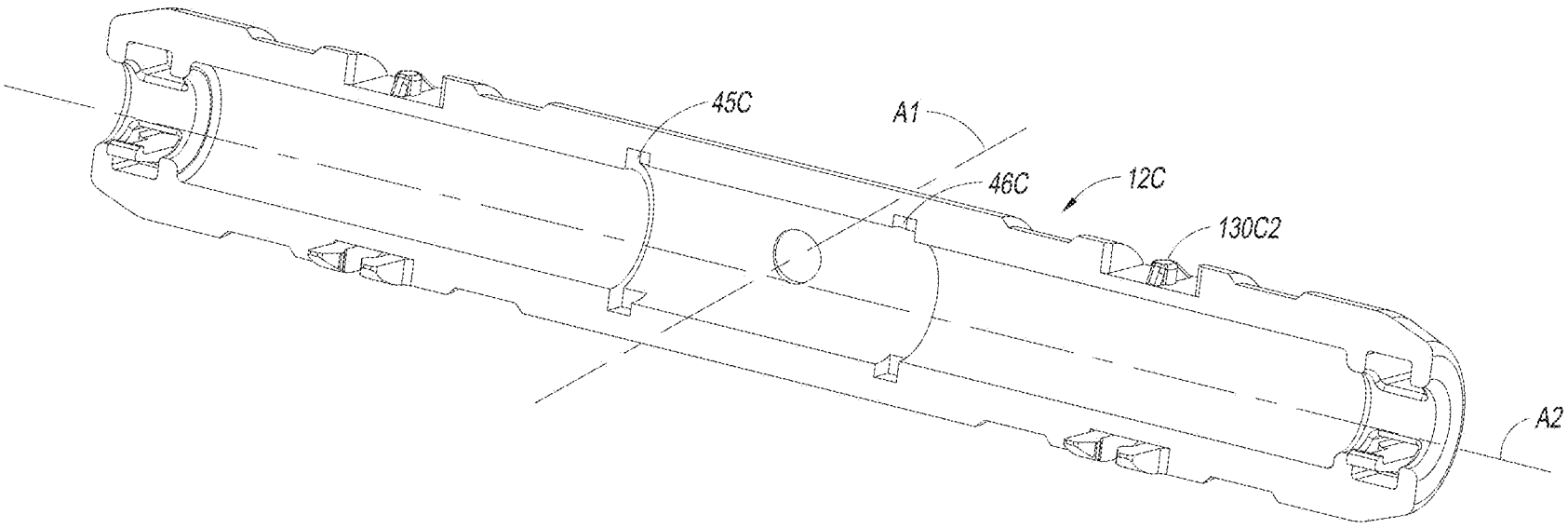
FIG. 33 illustrates a perspective view of a housing portion of the splice connector assembly of FIG. 31.
Figure 34:
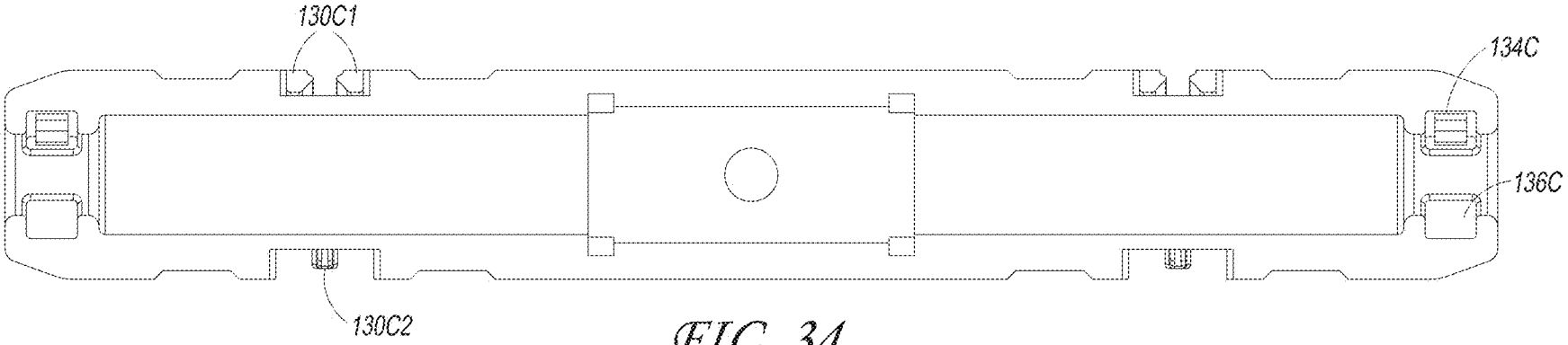
FIG. 34 illustrates a top view of the housing portion of FIG. 33.
Figure 35:
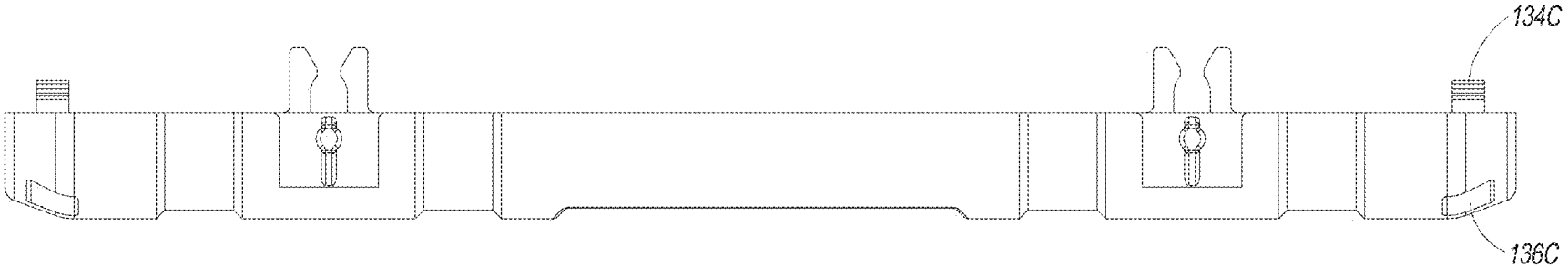
FIG. 35 illustrates a side view of the housing portion of FIG. 33.
Figure 36:
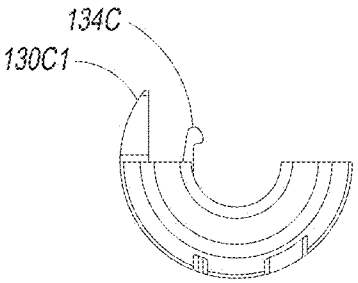
FIG. 36 illustrates an end view of the housing portion of FIG. 33.
Figure 37:
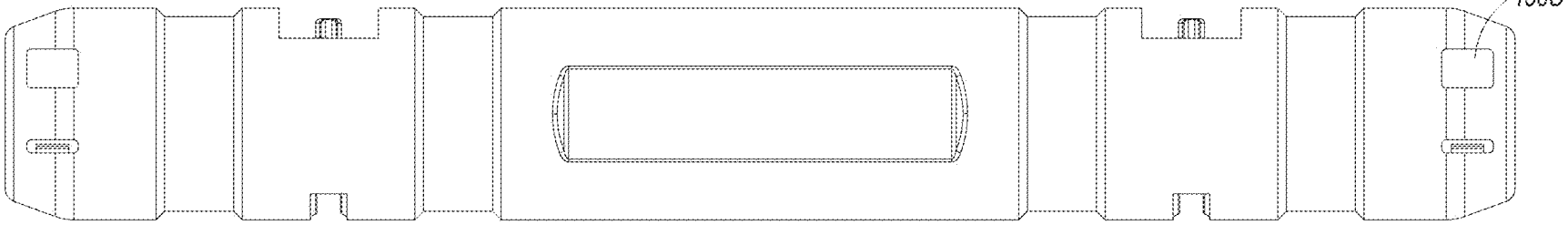
FIG. 37 illustrates a bottom view of the housing portion of FIG. 33.

The socket 22C can include an orientation feature 74C and the pin 24C can include an orientation feature 76C. The orientation features 74C, 76C can comprise a radially inwardly or outwardly keyway, groove, rib, or otherwise. In the embodiment illustrated in FIG. 32, the orientation features 74C, 76C comprise radially extending ribs. The orientation features 74C, 76C of the socket 22C and pin 24C can be configured to mate with the orientation features 45C, 46C of the housing 12C. For example, as illustrated in FIGS. 32 and 33, in some embodiments, the orientation features 45C, 46C comprise grooves and the orientation features 74C, 76C comprise ribs that can be received in the grooves 45C 46C. This can provide a predetermined orientation of the pin 22C and socket 24C relative to the housing 12C when installed inside the housing 12C. In some variants, the orientation features 45C, 46C comprise ribs and the orientation features 74C, 76C comprise grooves. Other types of mating orientation features 45C, 46C, 74C, 76C are contemplated, such as ball detents, friction fits, or otherwise.

Certain embodiments are configured to provide support to one or both of the cables C1, C2. For example, as illustrated in FIGS. 33-37, the axial ends of the housing 12C can include a reduced radial diameter. In some embodiments, the axial ends of the housing 12C include securing features, such as a hook 134C and an opening 136C. In various embodiments, the hook 134C can be received in the opening 136C of the mating housing portion. This can facilitate securing the housing portions together and/or can provide cable support. In various embodiments, the housing 12C is configured to provide strain relief to the cables C1, C2.

The splice connector assembly 10C can be configured to seal around the cables C1, C2 and/or socket 22C and pin 24C. In some embodiments, the assembly 10C comprises a heat shrink sleeve. For example, the housing 12C can be made of a material that reduces in diameter and/or otherwise shrinks in response to the application of heat, such as at least about 100° C. In various embodiments, the splice connector assembly 10C is configured to inhibit or prevent liquid intrusion into the assembly 10C.

Certain Terminology

Although various splice connectors have been disclosed in the context of certain embodiments and examples, this disclosure extends beyond the specifically disclosed embodiments to other alternative embodiments and/or uses of the embodiments and certain modifications and equivalents thereof. For example, although the description above is in the context of splicing electrical cables, this disclosure applies to splicing other types of cables as well, such as optical cables. Use with any structure is expressly within the scope of this invention. Various features and aspects of the disclosed embodiments can be combined with or substituted for one another in order to form varying modes of the assembly. The scope of this disclosure should not be limited by the particular disclosed embodiments described herein.

Certain features that are described in this disclosure in the context of separate implementations or embodiments can also be implemented in combination in a single implementation or embodiment. Conversely, various features that are described in the context of a single implementation or embodiment can also be implemented in multiple implementations or embodiments separately or in any suitable subcombination. Moreover, although features may be described above as acting in certain combinations, one or more features from a claimed combination can, in some cases, be excised from the combination, and the combination may be claimed as any subcombination or variation of any subcombination.

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Some embodiments have been described in connection with the accompanying drawings. The figures may be to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

SUMMARY

In summary, various embodiments and examples of splice connectors have been disclosed. Although these have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The invention claimed is:

1. A splice connector assembly comprising:
- a connection unit comprising:
  - a female terminal configured to receive an end of a first cable; and
  - a male terminal configured to receive an end of a second cable and to mate with the female terminal to provide an electrical connection between the first and second cables;
- an outer housing comprising a first end, a second end, and an inner passage, the first and second ends each comprising a first anti-rotation feature, the inner passage configured to receive the connection unit;
- a first securing mechanism on the first end of the outer housing;
- a second securing mechanism on the second end of the outer housing;
- wherein the first and second securing mechanisms each comprise:
  - a coupling nut engaged with the outer housing, the coupling nut comprising a second anti-rotation feature;
  - a washer comprising:
    - an inner face comprising a third anti-rotation feature that is engaged with the first anti-rotation feature of the outer housing; and
    - an outer face comprising a fourth anti-rotation feature that is engaged with the second anti-rotation feature of the coupling nut; and
  - an elastomeric sealing gland longitudinally compressed between the washer and the connection unit.

2. The splice connector assembly of claim 1, wherein the first and third anti-rotation features comprise a mating flange and recess.

3. The splice connector assembly of claim 2, wherein the second and fourth anti-rotation features comprise mating teeth.

4. The splice connector assembly of claim 3, wherein the elastomeric sealing gland comprises an aperture having a non-concentric cross-sectional shape.

5. The splice connector assembly of any of claim 4, wherein the coupling nut is threaded to the housing.

6. The splice connector assembly of claim 5, wherein the male and female terminals each comprise:
- an outer body comprising a first locking mechanism;
- a retention cap comprising a second locking mechanism that is engaged with the first locking mechanism;
- an inner body received in the outer body;
- a plurality of contacts received in the inner body; and
- a removable securing door positioned radially between any of the plurality of contacts and the outer body.

7. The splice connector assembly of claim 6, wherein the outer housing further comprises a first orientation feature, and wherein the connection unit further comprises a second orientation feature that mates with the first orientation feature in only one circumferential orientation of the connection unit relative to the outer housing.

8. The splice connector assembly of claim 7, wherein the first orientation feature comprises one of a projection and a slot and the second orientation feature comprises the other of the projection and the slot.

9. A splice connector assembly comprising:
- a connection unit comprising:
  - a female terminal configured to receive an end of a first cable; and
  - a male terminal configured to receive an end of a second cable and to mate with the female terminal to provide an electrical connection between the first and second cables;
- an outer housing comprising a first end, a second end, and an inner passage, the inner passage configured to receive the connection unit;
- a first securing mechanism on the first end of the outer housing;
- a second securing mechanism on the second end of the outer housing;
- wherein the first and second securing mechanisms each comprise:
  - a coupling nut engaged with the outer housing;
  - a washer comprising a flange that is fit in a corresponding recess of the outer housing; and
  - an elastomeric sealing gland longitudinally compressed between the washer and the connection unit.

10. The splice connector assembly of claim 9, wherein the elastomeric sealing gland comprises an aperture having a non-concentric cross-sectional shape.

11. The splice connector assembly of claim 10 wherein the coupling nut is threaded to the outer housing.

12. The splice connector assembly of claim 11, wherein the coupling nut further comprises a plurality of teeth and the washer further comprises a plurality of teeth, the teeth of the coupling nut and the washer being engaged together, thereby inhibiting rotation of the coupling nut relative to the washer.

13. The splice connector assembly of claim 12, wherein the outer housing further comprises a flange that is fit in a corresponding recesses of the washer.

14. The splice connector assembly of claim 13, wherein the washer further comprises a plurality of flanges that are fit in corresponding recesses of the outer housing.

15. The splice connector assembly of claim 14, wherein the male and female terminals each comprise:

an outer body comprising a first locking mechanism;

a retention cap comprising a second locking mechanism that is engaged with the first locking mechanism;

an inner body received in the outer body;

a plurality of contacts received in the inner body; and a removable securing door positioned radially between the one or more of the plurality of contacts and the outer body.

16. The splice connector assembly of claim 15, wherein the outer housing further comprises a first orientation feature, and wherein the connection unit further comprises a second orientation feature that mates with the first orientation feature in only one circumferential orientation of the connection unit relative to the outer housing.

17. The splice connector assembly of claim 16, wherein the first orientation feature comprises one of a projection and a slot and the second orientation feature comprises the other of the projection and the slot.

18. A method of splicing a cable, the method comprising:

inserting a socket connected to a first cable into a first end of a housing, the housing comprising a longitudinal axis;

inserting a pin connected to a second cable into a second end of the housing, the second end opposite the first end;

coupling the socket and the pin inside the housing to form a connection unit;

connecting a first securing mechanism to the first end of the housing, wherein connecting the first securing mechanism comprises:

connecting a first coupling nut to the first end of the housing;

pressing, with the first coupling nut, a first washer longitudinally;

engaging a flange of the first washer with a first mating recess of the housing;

compressing a first sealing gland between the first washer and the connection unit; and forming, with the compressed first sealing gland, a seal around the first cable;

and connecting a second securing mechanism to the second end of the housing, wherein connecting the second securing mechanism comprises:

connecting a second coupling nut to the second end of the housing;

pressing, with the second coupling nut, a second washer longitudinally;

engaging a flange of the second washer with a second mating recess of the housing;

compressing a second sealing gland between the second washer and the connection unit; and forming, with the compressed second sealing gland, a seal around the second cable.

19. The method of claim 18, further comprising engaging teeth on a face of the first coupling nut with mating teeth on a face of the first washer, and engaging teeth on a face of the second coupling nut with mating teeth on a face of the second washer.

* * * * *